US005996670A

United States Patent [19]

Igarashi

[11] Patent Number: 5,996,670

[45] Date of Patent: Dec. 7, 1999

[54] BALANCED SHUTTER AND BALANCING DEVICE THEREOF

[75] Inventor: Hisahiro Igarashi, Koshigaya, Japan

[73] Assignee: Yamato Tape Co., Ltd., Tokyo, Japan

[21] Appl. No.: 09/077,556

[22] PCT Filed: Oct. 21, 1997

[86] PCT No.: PCT/JP97/03792

§ 371 Date: Jun. 1, 1998

§ 102(e) Date: Jun. 1, 1998

[87] PCT Pub. No.: WO98/17888

PCT Pub. Date: Apr. 30, 1998

[30] Foreign Application Priority Data

Oct. 23, 1996 [JP] Japan ..... 8-281098

[51] Int. Cl.[6] ..... E06B 9/08

[52] U.S. Cl. ..... 160/133; 160/191; 160/193

[58] Field of Search ..... 160/133, 189, 160/191, 192, 193, 32, 313, 319

[56] References Cited

U.S. PATENT DOCUMENTS 5,460,216 10/1995 Hirao et al. ..... 160/133

FOREIGN PATENT DOCUMENTS 51-78044 7/1976 Japan .
54-45312 12/1979 Japan .
4-84699 7/1992 Japan .
5-163880 6/1993 Japan .
6-16072 4/1994 Japan .
8-121061 5/1996 Japan .
9-72174 3/1997 Japan .

*Primary Examiner*—David M. Purol
*Attorney, Agent, or Firm*—Fay, Sharpe, Beall, Fagan, Minnich & McKee

[57] ABSTRACT

A balancing device (11) has a first balance pulley (20) provided in a hoisting drum (3) and a second balance pulley (40) connected to a coil spring (31). These pulleys are connected through a tension wire (50). The first balance pulley has a main pulley portion (25) for taking-up the tension wire at the beginning of a feed-out process from a fully opened position, and a zero-point return pulley portion (26) for taking-up the tension wire from halfway. The zero-point return pulley portion has an outer circumferential shape in which the tension wire passes the pulley axial center at a fully shut position. The second balance pulley (40) has a cylindrical portion (46) for feeding-out the tension wire at the beginning of the feed-out process from the fully opened position, and a conical portion (47) for feeding-out the tension wire from halfway. The conical portion has a shape in which its diameter is smaller on the cylindrical portion side. There is provided an operation rope unit (11) having an operation rope (70) for operating the hoisting drum to rotate on the indoor side. Further, by decentering the rotation center of a large pulley (220), a mountain-shaped characteristic is given to balance torque every rotation.

12 Claims, 32 Drawing Sheets

FIG.10

| No | NUMBER OF TURNS | TORQUE (kg·mm) | Ⓐ | | Ⓑ | | Ⓒ | |
|---|---|---|---|---|---|---|---|---|
| | | | RADIUS OF ROTATION | TENSILE FORCE (kg·f) | RADIUS OF ROTATION | TENSILE FORCE (kg·f) | NUMBER OF TURNS | TENSILE FORCE (kg·f) |
| 1 | 15 | 975 | /30 | 32.5 | /37 | 26.35 | /38 | 25.65 |
| 2 | 14 | 910 | | 30.33 | | 24.59 | /36.322 | 25.05 |
| 3 | 13 | 845 | | 28.16 | | 22.83 | /34.644 | 24.39 |
| 4 | 12 | 780 | | 26 | /37 | 21.08 | /32.966 | 23.66 |
| 5 | 11 | 715 | | 23.83 | /35.322 | 20.24 | /31.288 | 22.85 |
| 6 | 10 | 650 | | 21.66 | /33.644 | 19.31 | /29.61 | 21.95 |
| 7 | 9 | 585 | | 19.5 | /31.966 | 18.30 | /27.932 | 20.94 |
| 8 | 8 | 520 | | 17.33 | /30.288 | 17.16 | /27 | 19.25 |
| 9 | 7 | 455 | | 15.16 | /28.61 | 15.90 | | 16.85 |
| 10 | 6 | 390 | | 13 | /26.932 | 14.48 | | 14.44 |
| 11 | 5 | 325 | | 10.83 | /25.254 | 12.86 | | 12.03 |
| 12 | 4 | 260 | | 8.66 | /23.576 | 11.02 | | 9.62 |
| 13 | 3 | 195 | | 6.5 | /21.898 | 8.90 | | 7.22 |
| 14 | 2 | 130 | | 4.33 | /20.22 | 6.42 | | 4.81 |
| 15 | 1 | 65 | | 2.16 | /18.542 | 3.50 | | 2.40 |
| 16 | 0 | 0 | | | | | | |

BALANCED SHUTTER AND BALANCING DEVICE THEREOF

TECHNICAL FIELD

The present invention relates to a balanced shutter and a balancing device thereof for opening/shutting an opening portion such as an entrance, a window, etc. of a building.

BACKGROUND ART

A balanced steel shutter having a hoisting drum provided with a balancing device with a built-in coil spring has come into wide use as a shutter, particularly as a light-weight shutter, for opening/shutting an entrance, a window, etc. of a building. A balancing device (spread type balancing device) used in such a shutter is configured such that spring torque is accumulated corresponding to the quantity of rotations of a hoisting drum by twisting a coil spring included in the hoisting drum when a slat curtain is fed-out from the hoisting drum to thereby balance this spring torque with weight torque (hoisting drum torque) of the slat curtain fed-out as balance torque of the hoisting drum so as to reduce an operation force required for opening the shutter. Consequently, even a shutter with a considerably large opening can be operated manually.

JP-A-5-163880 discloses a technique in which spring torque of a balancing device is corrected so that the balance torque transmitted to a hoisting drum when the shutter is shut fully is made to be substantially zero. This balancing device is mainly used for a shutter with an air-slit type aluminum roll-formed slat (an air-slit type shutter). The balancing device has a balance pulley rotating synchronously with the hoisting drum, a tension wire one end of which is attached to the balance pulley, and a spring means for giving a spring force to this tension wire. The balance pulley has a main pulley portion for taking-up the tension wire when the slat curtain is shut, and a zero-point return pulley portion provided in one end of this main pulley portion continued to the main pulley portion to take up the tension wire. This zero-point return pulley portion has an outer circumferential shape by which the tension wire passes the axial center of the main pulley portion when the slat curtain is taken out to the position where the slat curtain is fully shut. Because of an outer circumferential shape of the zero-point return pulley portion, the line of action of the tension wire passes the axial center of the main pulley portion when the tension wire is wound around the zero-point return pulley portion. Therefore, though spring torque of the spring means acts on the tension wire, the force is not transmitted to the hoisting drum as torque, so that balance torque is not generated. Consequently, only the own weight of the slat curtain acts when the slat curtain is in its fully shut position with such an advantage that it is possible to shut the air slit in the fully shut position.

DISCLOSURE OF THE INVENTION

However, the above-mentioned conventional balanced shutters have problems as follows.

A. Problems in a Shutter with a Spread Type Balancing Device (1-1) In a spread type balancing device having a coil spring built in a hoisting drum, hoisting torque generated in the hoisting drum by the load of a slat curtain and its winding diameter shows a mountain-like characteristic with respect to the quantity of rotations of the hoisting drum, while spring torque of the coil spring shows a characteristic like a straight line crossing the mountain obliquely with respect to the quantity of rotations of the hoisting drum. Therefore, though the hoisting torque and the spring torque are balanced completely at the two points where they cross each other, there is a significant torque difference in any other place. It is therefore difficult to make the slat curtain stand still in a desired position except the two crossing points. From this reason, an air slit is opened in the fully shut position when the spread type balancing device is used in an air-slit type shutter. Accordingly, the spread type balancing device could not be used in the air-slit type shutter, and the target for use of the spread type balancing device was limited to a steel shutter.

(1-2) In addition, in the open/shut operation, a lowermost end slat or a lower-portion slat is moved up/down by his/her hand. However, because a significant torque difference is generated in positions other than the two crossing points as described above, it is necessary to open/shut the slat curtain with great force when the shutter is fully opened/shut. Therefore, the lower end portion of the curtain hits against an upper frame or a lower frame of a sash, or a floor, so that a loud collision sound is often generated. This collision sound is not only uncomfortable for the operator but also a nuisance for the neighbors in a city place.

(1-3) In addition, because the open/shut operation is performed manually as described above, a considerable force is required for a user in a posture of stoop. Some users complain of lumbago.

(1-4) Further, the load of the slat curtain is given to the floor or the lower frame of the sash when the shutter is in the fully shut position. Accordingly, while the hoisting drum torque based on the curtain's own weight becomes zero, the spring torque (=balance torque) of the coil spring takes the maximum value, so that the slat curtain is left in the suspended state. Therefore, lock in the fully shut position is an essential condition. In addition, if the lock is released, the shutter will be opened in an instant. This is a problem in prevention of crime.

B. Problems in a Shutter Disclosed in JP-A-5-163880

(2-1) In a shutter with an improved balancing device disclosed in JP-A-5-163880, by the effect of the zero-point return pulley portion, spring torque does not act on the hoisting drum when the slat curtain is in the fully shut position, as mentioned above. Accordingly, only the own weight of the slat curtain acts on the hoisting drum, so that it is possible to shut an air slit in the fully shut position when the balancing device is used in an air-slit type shutter. That is, the above-mentioned problem (1-1) is solved. In addition, because there is no fear that the shutter is opened immediately when the lock is released, the shutter is superior in prevention of crime. That is, the above-mentioned problem (1-4) is solved.

However, in this improved balancing device, it was found that priority is given to the point that balance torque in the fully shut position of the slat curtain was made zero, and the pulley shape was not suitable in portions other than the zero-point return pulley portion. That is, it was observed that the slat curtain was heavy immediately before the shutter was fully shut, and, on the contrary, the slat curtain showed a tendency to Jump up (or dash) when the shutter was moved up immediately after the fully shut shutter was opened. This is because balance torque in that portion is much larger than hoisting drum torque. There occur some troubles that a considerably large sound is generated when the slat curtain dashes, and the operation rope is caught in a wheel so as to detach from a groove of the wheel when an operation rope is used as a manual operation means.

(2-2) In addition, there are a wide variety of shutters, even with regard to differences in materials and shapes of slats.

For example, as for the materials used, there are various shutters made from steel, stainless steel, aluminum extrusion material, aluminum roll form, wood, and plastic. Even the steel slats of the same material are subdivided, based on their thickness, into 0.3 mm to 0.5 mm, 0.5 mm to 0.8 mm, 0.8 mm to 1.2 mm, 1.2 mm to 1.5 mm, and 1.5 mm to 2.0 mm. Not to say, the sectional shapes of slats are multifarious.

The improved balancing device disclosed in JP-A-5-163880 was mainly developed for a shutter using an air-slit type aluminum roll-formed slat (working width: 30 to 40 mm, inter-slat movement: 3 to 4 mm, and unit weight: 3.0 to 3.5 $Kg/m^2$). In the case of any other shutter such as a steel shutter with no air slit, an aluminum extruded slat shutter, or the like, the torque adjustment curve is largely different from that of the air-slit type aluminum roll-formed slat shutter, and the unit weight is much larger, so that the balancing device designed for the air-slit type shutter cannot be used as it is for any other shutter. Further, in the improved balancing device, the pulley shape is not suitable for the pulley portions except the zero-point return pulley portion as mentioned above, so that it is difficult to change the design of the improved balancing device for any other shutter.

(2-3) In addition, even if the design of the improved balancing device is changed for any other shutter, for example, a steel shutter, there still occurs the above-mentioned problem (2-1) that the slat curtain is heavy immediately before the shutter is fully shut, and on the contrary, the slat curtain dashes immediately after the fully shut shutter is opened. Further, though the maximum manual tensile force is defined to 7 kgf or less according to the Blind Standards when the shutter is opened manually, the shutter can be operated preferably by about 3 to 4 kgf if possible, in consideration of the frequency in use at home and the number of shutters. But, in an example in which the design of the improved balancing device was changed for a steel shutter, a large operation force of 10 kg or more was required immediately before the shutter was fully shut.

In addition, if a reduction mechanism for reducing the operation speed of the operation rope and increasing the operation force is provided between the operation rope and the hoisting drum, the operation force can be reduced. But, in that case, the operation speed is so low that it is inevitable to take much time for open/shut operation to thereby lower the operation property.

It is an object of the present invention to further improve the above-mentioned improved balancing device so that the balancing device can be used in any sort of slats, and to provide a balanced shutter and a balancing device thereof which does not generate collision sound or dash at the time of open/shut operation, and have superior operation property.

It is a second object of the present invention to provide a balanced shutter in which balance torque is made to follow the hoisting drum torque having small mountain-like torque changes which appear in hoisting drum torque at every rotation, so that the operation force at the time of opening/shutting the shutter can be more reduced over a wide range from the fully shut position of the shutter to the fully opened position of the same. (1) In order to attain the above object, according to the present invention, provided is a balanced shutter comprising: a hoisting drum for taking-up and feeding-out a slat curtain; a balancing device for accumulating spring torque corresponding to the quantity of rotations of the hoisting drum when the slat curtain is fed out from the hoisting drum, thereby balancing the spring torque with hoisting drum torque due to the slat curtain fed out; and a manual operation means for operating the hoisting drum so as to rotate the hoisting drum; characterized in that the balancing device includes: a coil spring for accumulating the spring torque; a first balance pulley provided at one end of the hoisting drum; a second balance pulley disposed adjacently to the first balance pulley and connected to one end of the coil spring; and a tension wire one end of which is connected to the first balance pulley while the other end is connected to the second balance pulley; the first balance pulley having a first pulley portion for taking-up the tension wire at the beginning of a feed-out process when the slat curtain is fed out at a fully opened position, and a second pulley portion for taking-up the tension wire from halfway of the feed-out process, the second pulley portion having an outer-circumferential shape in which the tension wire passes an axial center of the first pulley portion when the slat curtain is fed out to a fully shut position; the second balance pulley having a third pulley portion for feeding-out the tension wire at the beginning of the feed-out process when the slat curtain is fed out at the fully opened position, and a fourth pulley portion for feeding-out the tension wire from halfway of the feed-out process, the fourth pulley portion having a tapered shape so that a diameter thereof is made smaller on the third pulley portion side; and the manual operation means having an operation rope for operating the hoisting drum to rotate the hoisting drum on the indoor side.

In the thus configured balanced shutter according to the present invention, when the operation rope is operated at the fully opened position of the shutter, the hoisting drum rotates in one direction, and the slat curtain is fed out downward to the fully shut state at last. While the slat curtain is fed out in such a manner, the tension wire is taken up around the first balance pulley from the second balance pulley. Consequently, the second balance pulley rotates to accumulate spring torque in the coil spring correspondingly to the quantity of rotations of the hoisting drum.

On the contrary, when the operation rope is operated at the fully shut position so as to rotate the hoisting drum in the reverse direction, the slat curtain is taken up upward to the fully opened state at last. While the slat curtain is taken up in such a manner, the spring torque accumulated in the coil spring is released so as to reduce the operation force of the operation rope. That is, the tension wire is taken up around the second balance pulley again by the spring torque of the coil spring so that a rotation force, that is, balance torque is generated in the hoisting drum to thereby balance the balance torque with gravity torque (hoisting drum torque) of the slat curtain fed out from the hoisting drum.

Then, in the fully shut position of the shutter, the tension wire passes the axial center of the first pulley portion because of the feature of the outer-circumferential shape of the second pulley portion of the first balance pulley. As a result, even if a tensile force acts on the tension wire by the spring torque of the coil spring, there arises no rotation torque in the first balance pulley. That is, there arises no balance torque due to the coil spring in the hoisting drum. Therefore, the taking-up force from the hoisting drum to the slat curtain does not act, but only the own weight of the slat curtain acts on the hoisting drum. Accordingly, a special lock for preventing the slat curtain from being moved up by the balance torque of the hoisting drum in the fully shut position is unnecessary. In addition, when the balancing device is used in an air-slit type shutter, an air slit can be shut in the fully shut position.

In addition, the inventor of the present application paid attention to the tensile force of the tension wire as a parameter concerning balance torque. As a result of various investigations on changes in the tensile force of the tension wire in accordance with the shape of the second balance pulley, it was found that such a tapered shape that the third pulley portion side of the fourth pulley portion of the second balance pulley had a smaller diameter showed a good tensile force to be able to follow the changes of hoisting drum torque well.

The shape of the second balance pulley in the present invention is based on this finding. By providing such a tapered shape that the third pulley portion side of the fourth pulley portion of the second balance pulley has a smaller diameter, together with the ideal shape of the first balance pulley, the force of the coil spring can be used most effectively and with accurate balance. As a result, there does not occur such a problem that the slat curtain is heavy immediately before the shutter is fully opened, and, on the contrary, the slat curtain dashes immediately after the fully shut shutter is opened. In addition, the shutter can be opened/shut quickly with a light operation force of about 3 to 4 kg.

Further, the difference between the hoisting drum torque and the balance torque is small all over the range of the shutter open/shut operation so that the shutter can be opened/shut smoothly in any position of the shutter open/shut operation.

Further, the wire tensile force curve is improved so that the shape of the first balance pulley can be made simple, and the balancing device can be used in any sort of shutters.

(2) In the above item (1), preferably, the tapered shape of the fourth pulley portion is a conical shape.

Thus, the tapered shape of the fourth pulley portion of the second balance pulley can be realized in the simplest form.

(3) In the above item (1), preferably, the first pulley portion and the third pulley portion have cylindrical shapes respectively.

Thus, the shape of the first pulley portion of the first balance pulley and the shape of the third pulley portion of the second balance pulley can be made simplest. (4) In the above item (1), preferably, the diameter of the first balance pulley is larger than that of the second balance pulley.

Thus, transmission torque of the balancing device can be increased, so that it is possible to reduce the spring torque of the coil spring for obtaining the same balance torque. Accordingly, the coil spring can be made compact. In addition, the tensile force of the tension wire is reduced so that the tension wire is hardly broken off. Accordingly, the safety is improved.

(5) In the above item (1), preferably, the manual operation means has a configuration in which a through hole is vertically formed in a door stop of a sash upper frame so that the operation rope is introduced to the indoor side through said through hole.

Thus, the operation rope can be introduced to the indoor side without giving any modification to a building body so that installation can be simplified on a large scale. In addition, there is no problem in strength and in appearance. Further, there arises no problem concerning the convenience for right-handed and left-handed persons.

(6) In the above item (1), preferably, the operation rope is connected to the hoisting drum through a reverse rotation preventing device which transmits a rotation operation from the operation rope to the hoisting drum but does not transmit rotation from the hoisting drum to the operation rope to thereby prevent the rotation of the hoisting drum.

Thus, the hoisting drum is rotated in either direction by operating the operation rope to carry out the open/shut operation of the shutter. On the other hand, in a case where the hoisting drum is rotated by an external force, or in an emergency where the tension wire is cut off in the fully opened position of the shutter, or the like, the hoisting drum is prevented from rotating. Accordingly, the safety is ensured.

(7) In the above item (6), preferably, the reverse rotation preventing device includes: a rotation shaft which is provided adjacently to the end portion of the hoisting drum opposite to the first balance pulley and which is connected to the hoisting drum through a rotation transmitting mechanism; a rope pulley which is supported rotatably on the rotation shaft and on which the operation rope is engaged; and an one-directional rotation transmitting mechanism which is provided between the rotation shaft and the rope pulley so that the rotation shaft is rotated by the rotation of the rope pulley but the rotation shaft is not rotated by the rotation of the rotation transmitting mechanism.

Thus, the reverse rotation preventing device transmits the rotation operation from the operation rope to the hoisting drum, but does not transmit the rotation from the hoisting drum to the operation rope. Accordingly, it is possible to prevent the hoisting drum from rotating.

(8) In the above item (1), preferably, an upper end slat of the slat curtain is connected to the hoisting drum through a lifting hook made from elastic material, and a stopper is provided at an upper end of a rail guide for guiding the opposite side portions of the slat curtain so that the stopper prevents upward movement of the upper end slat displaced away from the hoisting drum.

As mentioned in the above item (1), the spring torque accumulated in the coil spring does not generate a rotation force (balance torque) in the hoisting drum in the fully shut position by the feature of the shape of the first balance pulley, so that a force in the lift-up direction does not act on the slat curtain from the hoisting drum. When the lifting hook is formed from elastic material by using this characteristic, the lifting hook is bent by its own elasticity in the fully shut position of the shutter so as to displace the upper end slat of the slat curtain away from the hoisting drum. Accordingly, even when the slat curtain is intend to open manually in the fully shut position, the upper end slat is prevented from moving upward by the stopper. Accordingly, it is possible to prevent the shutter from being opened illegally from the outdoor side. On the other hand, when the operation rope is operated to rotate the hoisting drum, the lifting hook is taken up to thereby release the bending. Therefore, the upper end slat is detached from the stopper, so that it is possible to open the slat curtain.

(9) Further, in order to attain the above object, according to the present invention, provided is a balancing device of a shutter for accumulating spring torque corresponding to the quantity of rotations of a hoisting drum when a slat curtain is fed out from the hoisting drum, thereby balancing the spring torque with hoisting drum torque due to the slat curtain fed out, characterized by comprising: a coil spring for accumulating the spring torque; a first balance pulley connected to the hoisting drum so as to rotate synchronously with the hoisting drum; a second balance pulley disposed adjacently to the first balance pulley and connected to one end of the coil spring; and a tension wire one end of which is connected to the first balance pulley while the other end is connected to the second balance pulley; the first balance pulley having a first pulley portion for taking-up the tension wire at the beginning of a feed-out process when the slat curtain is fed out at a fully opened position, and a second pulley portion for taking-up the tension wire from halfway of the feed-out process, the second pulley portion having an outer-circumferential shape in which the tension wire passes an axial center of the first pulley portion when the slat curtain is fed out to a fully shut position; the second balance pulley having a third pulley portion for feeding-out the tension wire at the beginning of the feed-out process when the slat curtain is fed out at the fully opened position, and a fourth pulley portion for feeding-out the tension wire from halfway of the feed-out process, the fourth pulley portion having a tapered shape so that a diameter thereof is made smaller on the third pulley portion side.

Thus, as mentioned in the above aspect (1), not only the balancing device can be used in any sort of slats but also it is possible to provide a balancing device in which any collision sound or dash is caused at the time of opening/shutting the shutter, and which is superior in operation property.

(10) In order to attain the second object, according to the present invention, provided is a balanced shutter comprising a hoisting drum for taking-up and feeding-out a slat curtain; a balancing device for accumulating spring torque corresponding to the quantity of rotations of the hoisting drum when the slat curtain is fed out from the hoisting drum, thereby balancing the spring torque with hoisting drum torque due to the slat curtain fed out; and a manual operation means for operating the hoisting drum so as to rotate the hoisting drum; characterized in that the balancing device includes: a coil spring for accumulating the spring torque; a first balance pulley provided at one end of the hoisting drum; a second balance pulley disposed adjacently to the first balance pulley and connected to one end of the coil spring; and a tension wire one end of which is connected to the first balance pulley while the other end is connected to the second balance pulley; the first balance pulley having a first pulley portion for taking-up the tension wire at the beginning of a feed-out process when the slat curtain is fed out at a fully opened position, and a second pulley portion for taking-up the tension wire from halfway of the feed-out process, the second pulley portion having an outer-circumferential shape in which the tension wire passes an axial center of the first pulley portion when the slat curtain is fed out to a fully shut position; the first balance pulley further having a rotation center in a position decentered from its central axis; the second balance pulley having a third pulley portion for feeding-out the tension wire at the beginning of the feed-out process when the slat curtain is fed out at the fully opened position, and a fourth pulley portion for feeding-out the tension wire from halfway of the feed-out process, the fourth pulley portion having a tapered shape so that a diameter thereof is made smaller on the third pulley portion side; the manual operation means having an operation rope for operating the hoisting drum to rotate the hoisting drum on the indoor side.

In the thus configured balanced shutter according to the present invention, when the operation rope is operated at the fully opened position of the shutter, the hoisting drum rotates in one direction, and the slat curtain is fed out downward to the fully shut state at last. While the slat curtain is fed out in such a manner, the tension wire is taken up around the first balance pulley from the second balance pulley. Consequently, the second balance pulley rotates to accumulate spring torque in the coil spring correspondingly to the quantity of rotations of the hoisting drum.

On the contrary, when the operation rope is operated at the fully shut position so as to rotate the hoisting drum in the reverse direction, the slat curtain is taken up upward to the fully opened state at last. While the slat curtain is taken up in such a manner, the spring torque accumulated in the coil spring is released so as to reduce the operation force of the operation rope. That is, the tension wire is taken up around the second balance pulley again by the spring torque of the coil spring so that a rotation force, that is, balance torque is generated in the hoisting drum to thereby balance the balance torque with gravity torque (hoisting drum torque) of the slat curtain taken out from the hoisting drum.

Then, in the fully shut position of the shutter, the tension wire passes the axial center of the first pulley portion because of the feature of the outer-circumferential shape of the second pulley portion of the first balance pulley. As a result, even if a tensile force acts on the tension wire by the spring torque of the coil spring, there arises no rotation torque in the first balance pulley. That is, there arises no balance torque due to the coil spring in the hoisting drum. Therefore, the taking-up force from the hoisting drum to the slat curtain does not act, but only the own weight of the slat curtain acts on the hoisting drum. Accordingly, a special lock for preventing the slat curtain from being moved up by the balance torque of the hoisting drum in the fully shut position is unnecessary. In addition, when the balancing device is used in an air-slit type shutter, an air slit can be shut in the fully shut position.

In addition, the inventor of the present application paid attention to the tensile force of the tension wire as a parameter concerning balance torque. As a result of various investigations on changes in the tensile force of the tension wire in accordance with the shape of the second balance pulley, it was found that such a tapered shape that the third pulley portion side of the fourth pulley portion of the second balance pulley had a smaller diameter showed a good tensile force to be able to follow the changes of hoisting drum torque well.

The shape of the second balance pulley in the present invention is based on this finding. By providing such a tapered shape that the third pulley portion side of the fourth pulley portion of the second balance pulley has a smaller diameter, together with the ideal shape of the first balance pulley, the force of the coil spring can be used most effectively and with accurate balance. Further, when the rotation center of the first balance pulley is provided in a position decentered from its central axis, the first balance pulley can follow mountain-shaped characteristic of hoisting drum torque generated in every rotation of the hoisting drum. Accordingly, the difference between the hoisting drum torque and the balance torque is further reduced all over the range of the shutter open/shut operation, so that it is possible to open/shut the shutter quickly with a light operation force.

Further, the wire tensile force curve is improved so that the shape of the first balance pulley can be also made simple, and the balancing device can be used in any sort of shutters.

(11) In the above item (10), preferably, the manual operation means has an operation terminal in the inside of the opening width of the shutter, and has a configuration in which the operation rope is introduced to the indoor side through a frame in an upper portion of a sash angle or a window opening or an inner wall of a building.

Thus, the operation rope can be introduced to the indoor side without giving any modification to the structure of a building, so that installation can be simplified on a large scale. In addition, there is no problem in strength and in appearance. Further, there arises no problem concerning the convenience for right-handed and left-handed use.

(12) In the above item (10), preferably, a pitch of a guide groove of the second balance pulley is made smaller than a pitch of a guide groove of the first balance pulley.

BRIEF DESCRIPTION OF THE DRAWINGS

FIG. 10 is a graph showing calculated values of a tensile force based on the three types of the second balance pulleys by table;

THE BEST MODE FOR CARRYING OUT THE INVENTION

An embodiment of the present invention will be described below with reference to the drawings. In this embodiment, the present invention is applied to a steel shutter.

Figure 1:
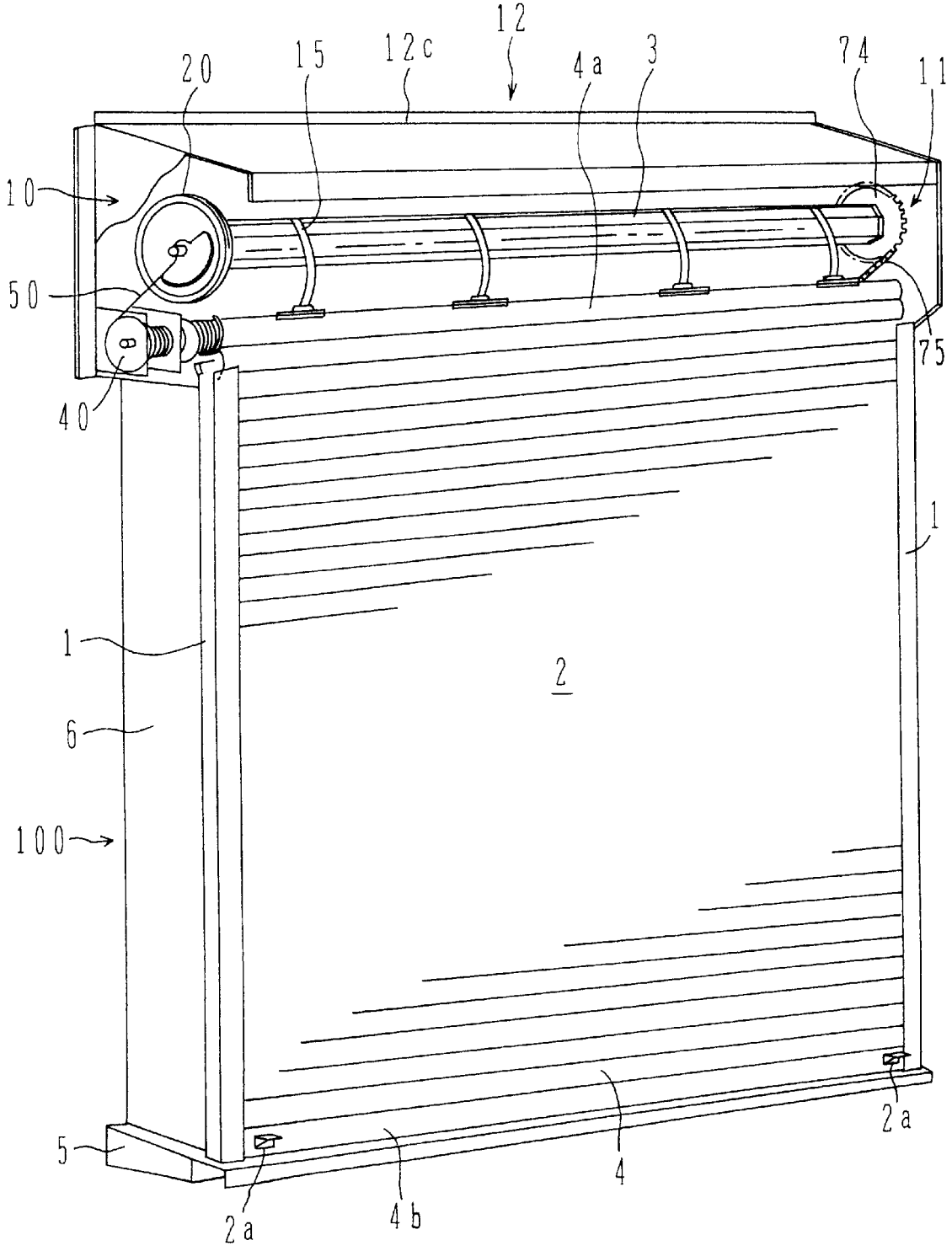
FIG. 1 is a perspective view of a balanced shutter according to an embodiment of the present invention, wherein a part (a side plate and a front plate) of a shutter case and a part of a balancing device are cut away.

In FIG. 1, a balanced shutter 100 in this embodiment has a pair of right and left guide rails 1 and 1 erected in parallel with each other and at a predetermined distance, a slat curtain 2 moved up and down under the guidance of these guide rails 1 and 1, a hoisting drum 3 for taking-up and feeding-out this slat curtain 2, a balancing device 10 provided on one end side of the hoisting drum 3, an operation rope unit 11 provided on the other end side of the hoisting drum 3, and a shutter case 12 for storing the hoisting drum 3, the balancing device 10, and shutter side parts of the operation rope unit 11.

In the slat curtain 2, a large number of steel slats 4, 4, . . . including an upper end slat 4*a* and a lower end slat 4*b* are connected to each other on their long sides flexibly so as to be made into a sheet of curtain. The upper end slat 4*a* is connected to the hoisting drum 3 through band-like lifting hooks 15, 15, . . . Stoppers 2*a* are provided on the opposite sides, respectively, of the lower end slat 4*b*. The reference numeral 5 represents a lower frame; and 6, a longitudinal frame.

Figure 2:
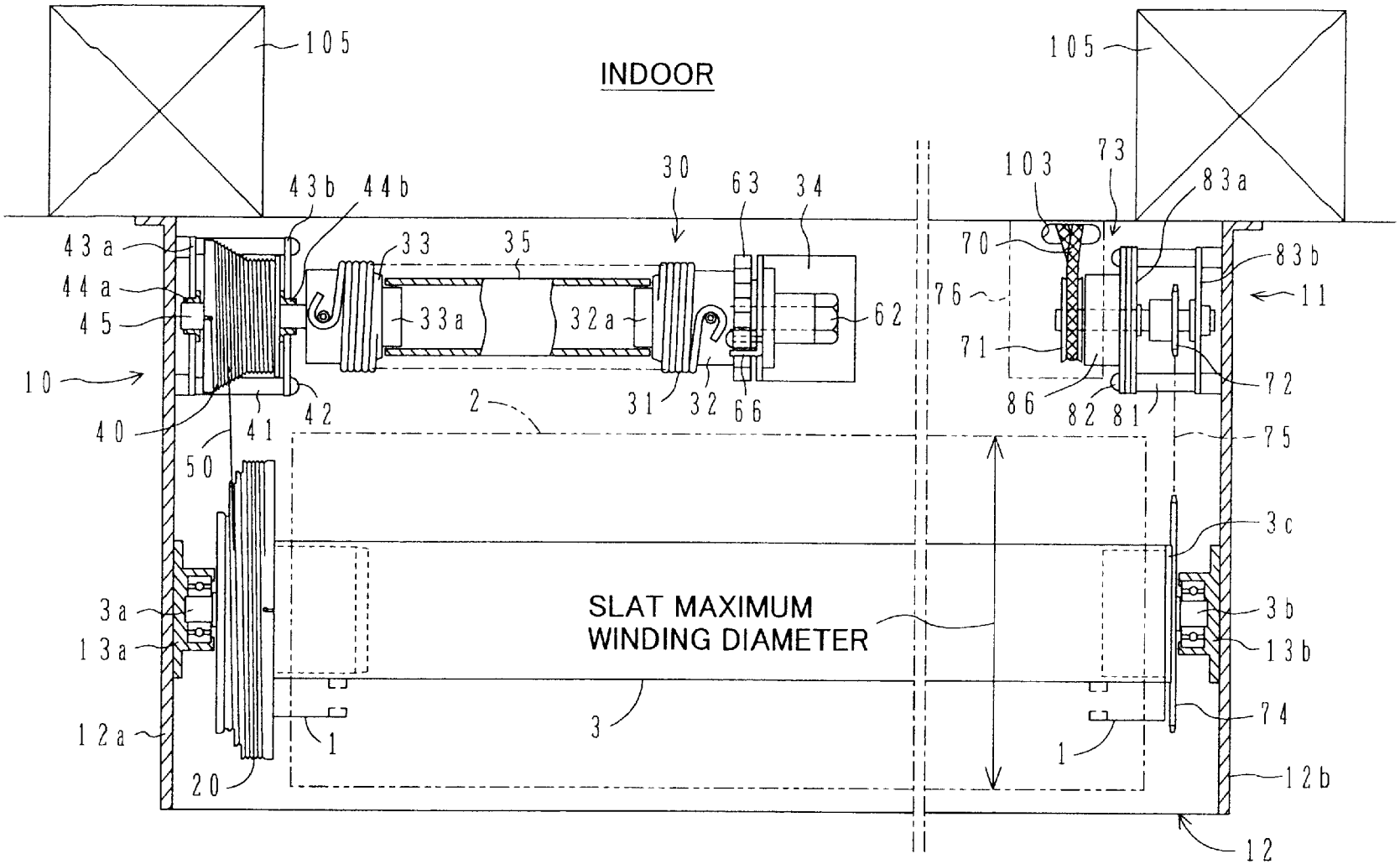
FIG. 2 is a plan view of the inside of the shutter case of the shutter shown in FIG. 1, wherein an upper plate of the shutter case is cut away, and a part thereof is illustrated sectionally.
Figure 3:
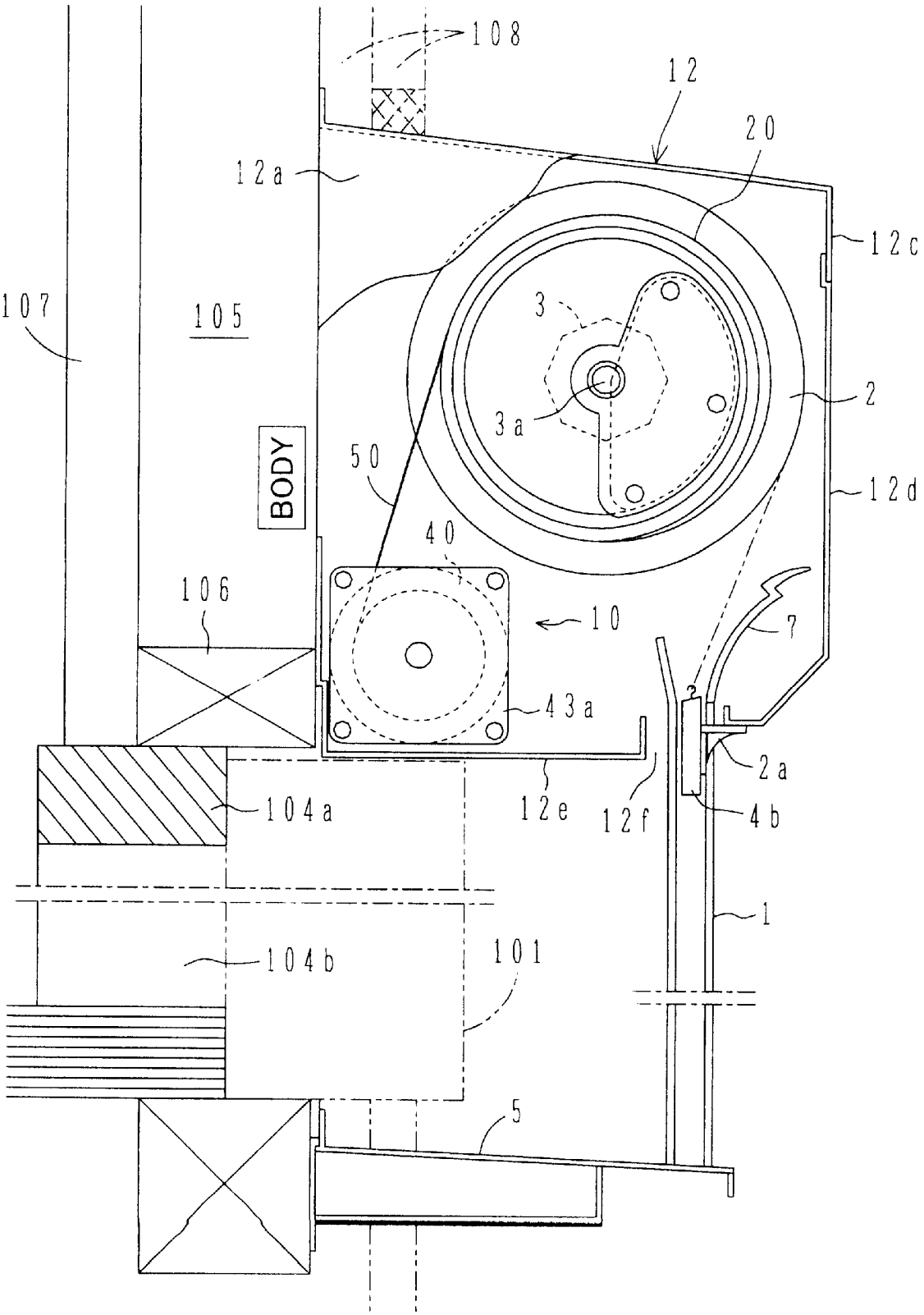
FIG. 3 is a side view of the fully opened state of the shutter shown in FIG. 1, wherein the side plate is mostly cut away.
Figure 4:
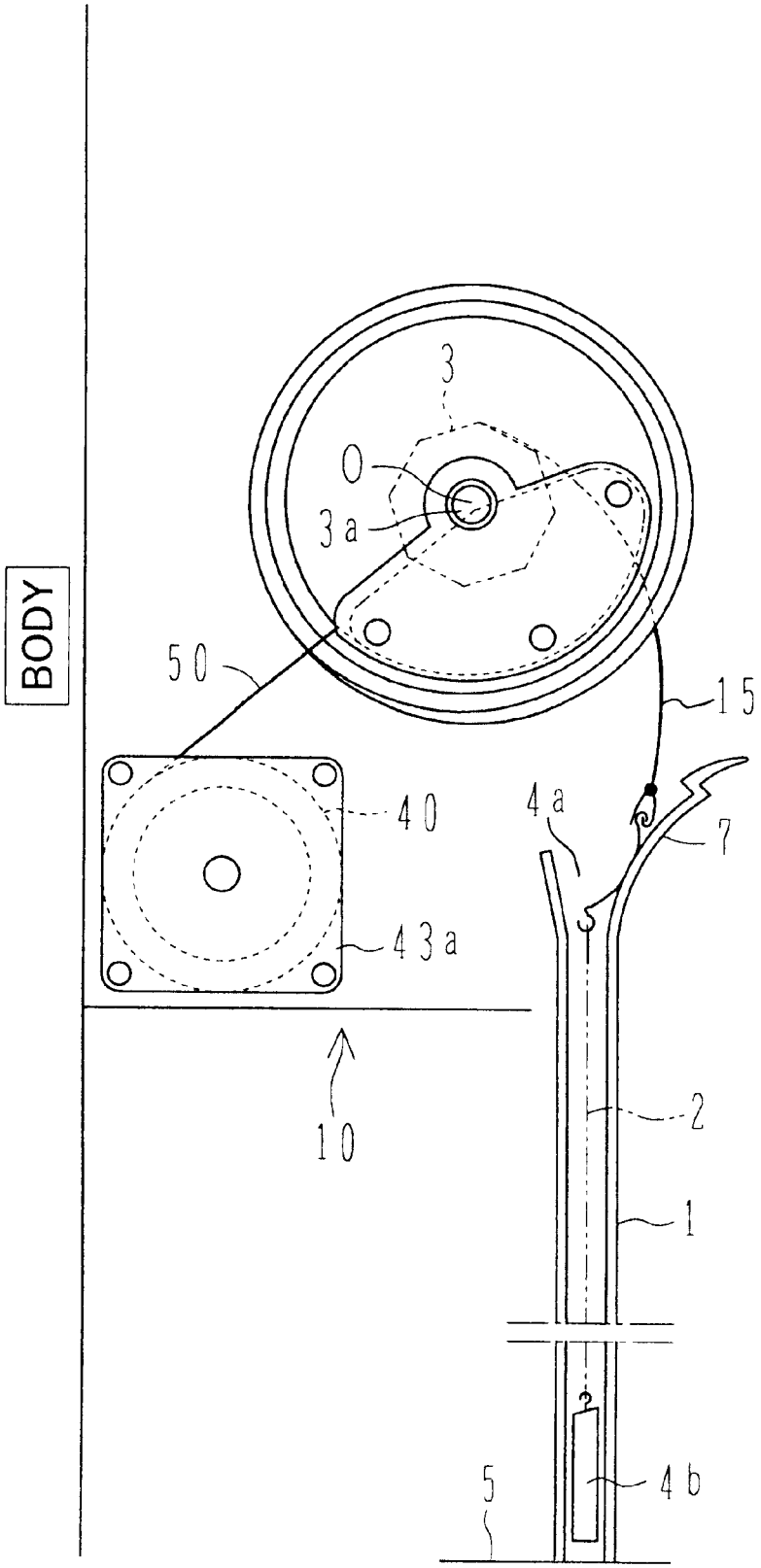
FIG. 4 is a side view of the shutter shown in FIG. 1 in the fully shut state, wherein the shutter case is cut away.

The shutter case 12 is, as shown in FIGS. 2 to 4, constituted by: a pair of right and left side plates 12*a* and 12*b* which serve as brackets; an upper plate 12*c* and a front plate 12*d* which constitute a case cover; and a bottom plate 12*e*. An opening groove 12*f* to which the upper end portions of the guide rails 1 and 1 are inserted and through which the curtain is moved up and down is formed between the lower end of the front plate 12*d* and the front end of the bottom plate 12*e*.

Bearings 13*a* and 13*b* are provided in the inside of the side plates 12*a* and 12*b*, respectively, of the shutter case 12. The hoisting drum 3 is supported rotatably by these bearings 13*a* and 13*b*.

The hoisting drum 3 is made of an octagonal steel pipe in this embodiment. A first pulley 20 is plugged into an end portion of the hoisting drum 3 and fixed thereto by a machine screw as illustrated in the left of FIG. 2, while an end cap 3*c* is attached, in the same manner as described above, to the other end portion of the hoisting drum 3 as illustrated in the right of FIG. 2. Rotation shafts 3*a* and 3*b* are provided at the centers of the first pulley 20 and the end cap 3*c*, respectively. These rotation shafts 3*a* and 3*b* are inserted into the bearings 13*a* and 13*b* respectively, so that the hoisting drum 3 is supported rotatably. The first balance pulley 20 constitutes a part of the balancing device 10. The hoisting drum 3 is not limited to the octagonal steel pipe, and it may be formed into any other shapes and may be made from any other materials.

The lifting hook 15 consists of spring steel. In addition, a stopper 7 for preventing the upper end slat 4*a* displaced by the elasticity of the spring steel of the lifting hook 15 from moving upward in the fully shut position where the slat curtain is fed out thoroughly is provided away from the hoisting drum 3 at the upper end of the rail guide 1, as shown in FIG. 4.

The balancing device 10 has a spring unit 30 supported on the bottom plate 12*e* of the shutter case 12. This spring unit 30 has a coil spring 31 for accumulating spring torque corresponding to the quantity of rotations of the hoisting drum 3 when the slat curtain 2 is fed out, and a second balance pulley 40 disposed adjacently to the first balance pulley 20 and connected to one end of the coil spring 31. A stainless steel tension wire 50 is provided between the first balance pulley 20 and the second balance pulley 40 so that one end of the stainless steel tension wire 50 is connected to the first balance pulley 20 while the other end is connected to the second balance pulley 40. The first balance pulley 20 is made to have a diameter which is larger than that of the second balance pulley 40.

The spring unit 30 has two housing plates 43*a* and 43*b* separated by four (or three) spacer pipes (or rods) 41, installed and fixed onto the side plate 12*a*, in the left of FIG. 2, by bolts 42. A shaft 45 is supported rotatably at the centers of these two housing plates 43*a* and 43*b* through bearings 44*a* and 44*b*. The second balance pulley 40 is key-connected to this shaft 45.

In addition, the spring unit 30 has a fixed boss 32 and a rotary boss 33 to which the opposite ends of the coil spring 31 are fixed respectively. The fixed boss 32 is supported on the bottom plate 12*e* by a pedestal 34, and the rotary boss 33 is connected integrally with the shaft 45. Small-diameter stepped portions 32*a* and 33*a* are formed in opposite portions of the fixed boss 32 and the rotary boss 33 respectively. A spring holding pipe 35 the opposite ends of which are plugged into these stepped portions 32*a* and 33*a* respectively is laid between the fixed boss 32 and the rotary boss 33. The coil spring 31 is held horizontally by this pipe 35.

Figure 5A:
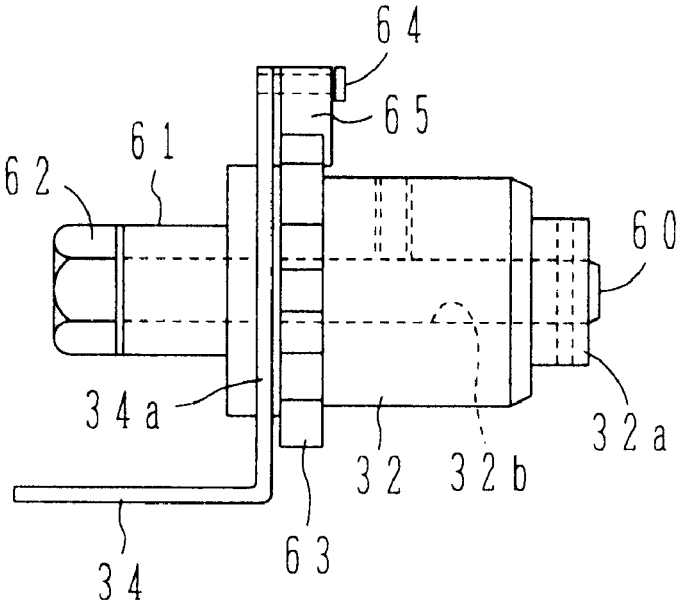
FIG. 5A is a front view illustrating a fixed boss with a ratchet in a spring unit.
Figure 5B:
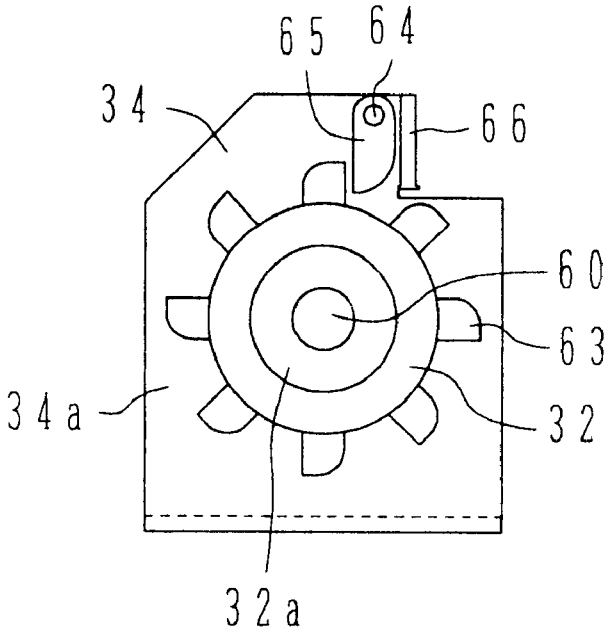
FIG. 5B is a side view illustrating a fixed boss with a ratchet in a spring unit.

The fixed boss 32 has a ratchet. As shown in FIG. 5, a hole 32*b* is formed at the center of the fixed boss 32. A shaft 60 is inserted into this hole 32*b*, and the fixed boss 32 is pin-connected to the shaft 60 in the stepped portion 32*a*. In addition, the pedestal 34 is formed into an L-shape. A bearing metal 61 is attached by screws to a leading edge portion 34*a* of the pedestal 34 on the opposite side to the fixed boss 32. The shaft 60 extends while penetrating the pedestal 34 and the bearing metal 61, and a bolt head 62 is attached to its end portion projecting from the bearing metal 61. Further, a ratchet 63 is cut in an end portion of the fixed boss 32 abutting against the pedestal 34, and a claw 65 is rotatably attached to the upper portion of the leading edge portion 34*a* of the pedestal 34 by a check pin 64. Further, a check plate 66 formed by bending a part of the pedestal 34 is provided at the rear of the claw 65. These check plate 66, claw 65 and ratchet 63 prevent the fixed boss 32 from rotating clockwise in FIG. 5, and allow the fixed boss 32 to rotate counterclockwise because the ratchet 63 pushes the claw 65 up.

The whole operation of the thus configured shutter 100 and the basic operation of the balancing device 10 are as follows.

At the fully opened position, the shutter 100 is in the state shown in FIG. 3, where the slat curtain 2 has been taken up on the hoisting drum 3 so that the stopper 2*a* hits against the lower end portion of the front plate 12*d* of the shutter case 12. At this time, most of the tension wire 50 has been taken up on the second balance pulley 40, so that the coil spring 31 is in the loosest state. When the operation rope unit 11 is operated to rotate the hoisting drum 3 clockwise in the drawing, the slat curtain 2 is fed out downward, and, at last, stops in the position where the lower end slat 4*b* hits against the lower frame 5, as shown in FIG. 4, so that the shutter 100 is brought into the fully shut state. While the slat curtain 2 is fed out downward in such a manner, the tension wire 50 is taken up around the first balance pulley 20 from the second balance pulley 40. Consequently, the second balance pulley 40 rotates to take up the coil spring 31 gradually so as to accumulate spring torque corresponding to the quantity of rotations of the hoisting drum 3.

On the contrary, when the operation rope unit 11 is operated at the fully shut position in FIG. 4 to rotate the hoisting drum 3 counterclockwise in the drawing, the slat curtain 2 is taken up upward, and, at last, stops in the position where the stopper 2*a* shown in FIG. 3 hits against the end portion of the shutter case, so that the shutter 100 is brought into the fully opened state. While the slat curtain 2 is taken up in such a manner, the spring torque accumulated in the coil spring 31 is released to reduce the operation force of the operation rope unit 11. That is, the tension wire 50 is taken up around the second balance pulley 40 again by the spring torque of the coil spring 31 so that a rotation force, that is, balance torque, is generated in the hoisting drum 3 to thereby balance the balance torque with gravity torque (hoisting drum torque) of the slat curtain fed out from the hoisting drum 3.

Then, in the fully shut position in FIG. 4, the spring torque accumulated in the coil spring 31 does not generate a rotation force (balance torque) in the hoisting drum 3 by the feature of the shape of the first balance pulley 20 (which will be described later). Accordingly, a force to lift the slat curtain 2 up does not act on the slat curtain 2 from the hoisting drum 3. The lifting hook 15 is bent because of the elasticity of spring steel as shown in FIG. 4, and the upper end slat 4*a* of the slat curtain 2 is displaced away from the hoisting drum 3 by this bending of the lifting hook 15. Therefore, even if the slat curtain 4 is intended to be opened manually at this fully shut position, the upward movement of the upper end slat 4*a* is prevented by the stopper 7, so that it is possible to prevent the shutter from being opened illegally from the outdoor side. On the other hand, when the operation rope unit 11 is operated to rotate the hoisting drum 3, there is no bending in the lifting hook 15. Accordingly, the upper end slat 4*a* leaves the stopper 7, so that it is possible to open the slat curtain 2.

In addition, the first balance pulley 20 of the balancing device 10 has a diameter larger than that of the second balance pulley 40. With the diameter of the pulley set thus, it is possible to increase transmission torque of the balancing device 10. That is, because torque=force×distance, when the spring torque of the coil spring 31 is constant, a rotation force (balance torque) generated in the hoisting drum 3 by the spring torque of the coil spring 31 pulling the tension wire 50 through the second balance pulley 40 so as to rotate the first balance pulley 20 becomes larger as the diameter of the first balance pulley 20 is larger than that of the second balance pulley 40. Therefore, it is possible to reduce the spring torque of the coil spring 31 to obtain the same balance torque, so that it is possible to reduce the size of the coil spring 31. In addition, because the tensile force of the tension wire 50 is reduced, the tension wire 50 becomes difficult to be broken off, so that the safety thereof is improved.

Further, the initial value of the spring torque of the coil spring 31 can be adjusted to a proper value by operating the ratcheted fixed boss 32. That is, when a tool is plugged into the bolt head 62 of the fixed boss 32 and rotated counterclockwise, the ratchet 63 pushes the claw 65 up to rotate the fixed boss 32, so that the spring torque of the coil spring 31 changes. Accordingly, the initial value of the spring torque can be set to a proper value when the shutter is installed. In addition, even if the initial value of the spring torque changes due to aged deterioration, it can be reset to a proper value easily.

Next, the features of the shapes of the first balance pulley 20 and the second balance pulley 40 of the balancing device 10 will be described in detail with reference to FIGS. 6 to 8.

Figure 6A:
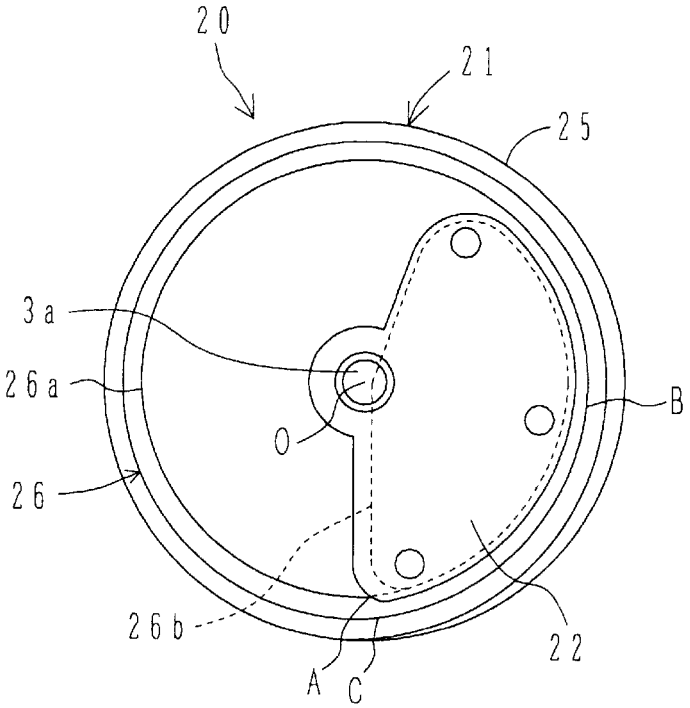
FIG. 6A is a front view illustrating a first balance pulley of the balancing device shown in FIG. 1.
Figure 6B:
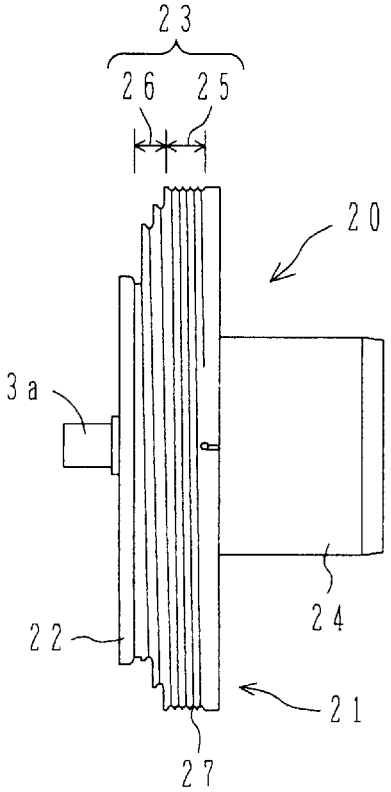
FIG. 6B is a side view illustrating a first balance pulley of the balancing device shown in FIG. 1.

First, the first balance pulley 20 is constituted by a body 21 and an end plate 22, as shown in FIG. 6. The body 21 has a pulley portion 23 and a portion 24 plugged into the hoisting drum 3. The end plate 22 is attached by screws to the end surface of the pulley portion 23 of the body 20. In addition, the above-mentioned rotation shaft 3*a* is provided on the end plate 22. Because the shape of the pulley portion 23 of the body 21 is different in accordance with the specification of the shutter, the body 21 is prepared differently in accordance with the specification of the shutter. The end plate 22 having the same shape is used in common for any sort of shutters.

The pulley portion 23 of the body 21 has a main pulley portion 25 and a zero-point return pulley portion 26. The main pulley portion 25 is constituted by a cylindrical portion. The zero-point return pulley portion 26 is constituted by a curved portion 26*a* having a diameter which becomes smaller gradually as a position goes away from the cylindrical portion of the main pulley portion, and a flat portion 26*b* which passes a position offset by about ½ of the diameter of the tension wire 50 from the axial center of the main pulley portion 25. A continuous spiral groove 27 for guiding the winding of the tension wire 50 is formed in the outer circumferential surface of the main pulley portion 25 and the outer circumferential surface of the zero-point return pulley portion 26.

Figure 7A:
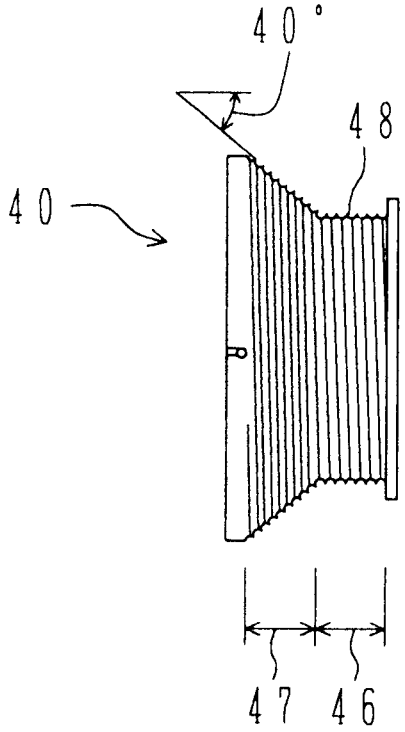
FIG. 7A is a side view illustrating a second balance pulley of the balancing device shown in FIG. 1.
Figure 7B:
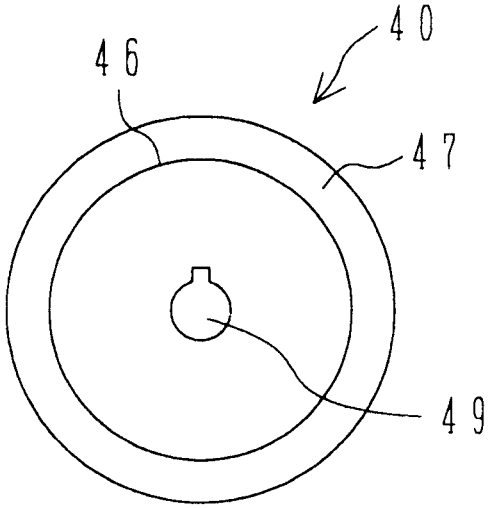
FIG. 7B is a front view illustrating a second balance pulley of the balancing device shown in FIG. 1.

The second balance pulley 40 has a cylindrical portion 46 and a conical portion 47, as shown in FIG. 7. The conical portion 47 has a conical shape having a diameter which is smaller on the cylindrical portion 46 side than on the side opposite to the cylindrical portion 46, and which is the same on the cylindrical portion 46 side as the diameter of the cylindrical portion 46. A continuous spiral groove 48 for guiding the winding of the tension wire 50 is formed also in the outer circumferential surface of the cylindrical portion 46 and the outer circumferential surface of the conical portion 47. In addition, a through hole 49 to which the shaft 45 is key-connected is formed at the center portions of the cylindrical portion 46 and the conical portion 47.

Figure 8A:
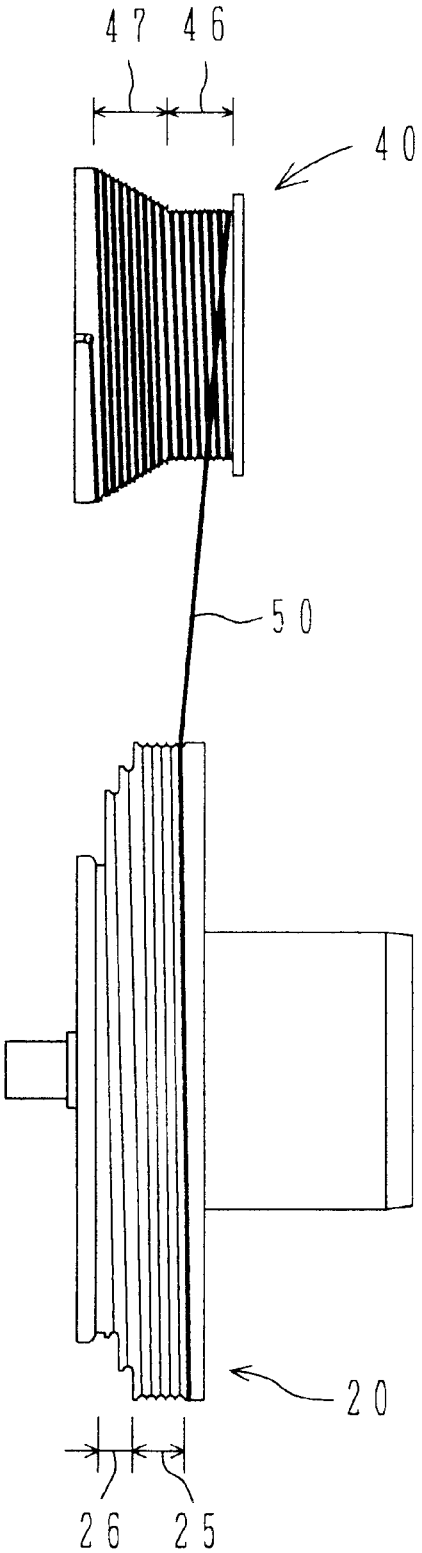
FIG. 8A is a view showing the relationship of winding of a tension wire between the first balance pulley and the second balance pulley in the fully opened position of the shutter.
Figure 8B:
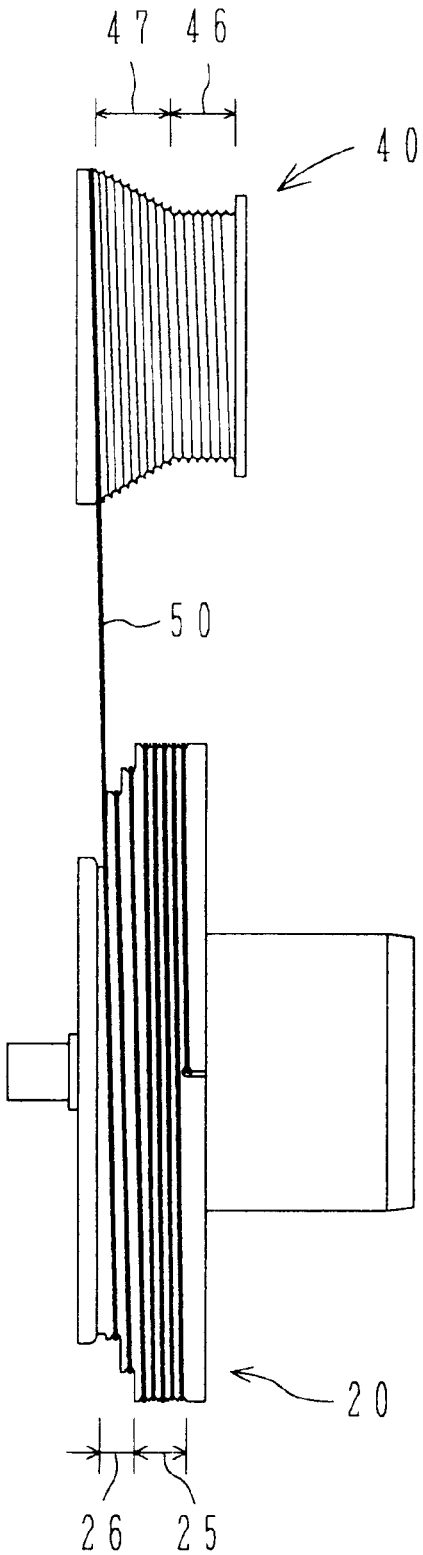
FIG. 8B is a view showing the relationship of winding of a tension wire between the first balance pulley and the second balance pulley in the fully shut position of the same.

When the slat curtain 2 is fed out at the fully opened position, the main pulley portion 25 of the first balance pulley 20 constitutes a first pulley portion for taking-up the tension wire 50 at the beginning of the feed-out process, as shown in FIG. 8(*a*). On the other hand, as shown in FIG. 8(*b*), the zero-point return pulley portion 26 constitutes a second pulley portion for taking-up the tension wire 50 from halfway, and the flat portion 26*b* of the zero-point return pulley portion 26 is positioned so that the tension wire 50 passes the axial center 0 of the main pulley portion 25 (the axial center of the first balance pulley 20) when the slat curtain 2 has been fed out to the fully shut position (see FIG. 4).

In addition, when the slat curtain 2 is fed out at the fully opened position, the cylindrical portion 46 of the second balance pulley 40 constitutes a third pulley portion for feeding-out the tension wire 50 at the beginning of the feed-out process, as shown in FIG. 8(*a*). On the other hand, as shown in FIG. 8(*b*), the conical portion 47 of the second balance pulley 40 constitutes a fourth pulley portion for feeding-out the tension wire 50 from halfway, and this conical portion 47 has a tapered shape having a diameter which is smaller on the cylindrical portion 46 side.

The operation of the thus configured balancing device 10 will be described.

First, the operation of the zero-point return pulley portion 26 of the first balance pulley 20 will be described with reference to FIG. 8.

When the slat curtain 2 is fed out downward at the fully opened position of the shutter, the tension wire 50 taken up around the second balance pulley 40 as shown in FIG. 8(*a*) is taken up around the first balance pulley 20. When the slat curtain 2 is fed out to the fully shut position, the tension wire 50 is taken up around the zero-point return pulley portion 26 of the first balance pulley 20 as shown in FIG. 8(*b*). Then, the flat portion 26*b* of the zero-point return pulley portion 26 is positioned so that the tension wire 50 passes the axial center 0 of the main pulley portion 25 (the axial center of the first balance pulley 20) when the slat curtain 2 has been fed out to the fully shut position as mentioned above. Therefore, when the slat curtain 2 has been fed out to the fully shut position in such a manner, the tension wire 50 passes the axial center 0 of the main pulley portion 25 (see FIG. 4), so that no rotation torque is generated in the first balance pulley 20 even if a tensile force acts on the tension wire 50 by the spring torque of the coil spring 31. That is, balance torque caused by the coil spring 31 is not generated in the hoisting drum 3.

Therefore, a winding-up force from the hoisting drum 3 to the slat curtain 2 does not act in the fully shut position of the shutter, but only the own weight of the slat curtain 2 acts on the hoisting drum 3. Accordingly, the slat curtain 2 is supported by the lower frame 5, and the hoisting drum 3 is made free. As a result, it will go well if there is provided such a simple lock device that the lifting hook 15 is formed of spring steel and the stopper 7 is provided at the upper end of the guide rail 1 as mentioned above. It becomes unnecessary to provide any special lock for preventing the slat curtain 2 from moving up by the balance torque of the hoisting drum 3 in the fully shut position.

In addition, when the balancing device is used in an air-slit type shutter, it is possible to shut an air slit in the fully shut position.

The operation of this zero-point return pulley portion 26 is described in detail in JP-A-5-163880.

Next, the operation of the conical portion 47 of the second balance pulley 40 will be described with reference to FIGS. 9 to 16.

Figure 9:
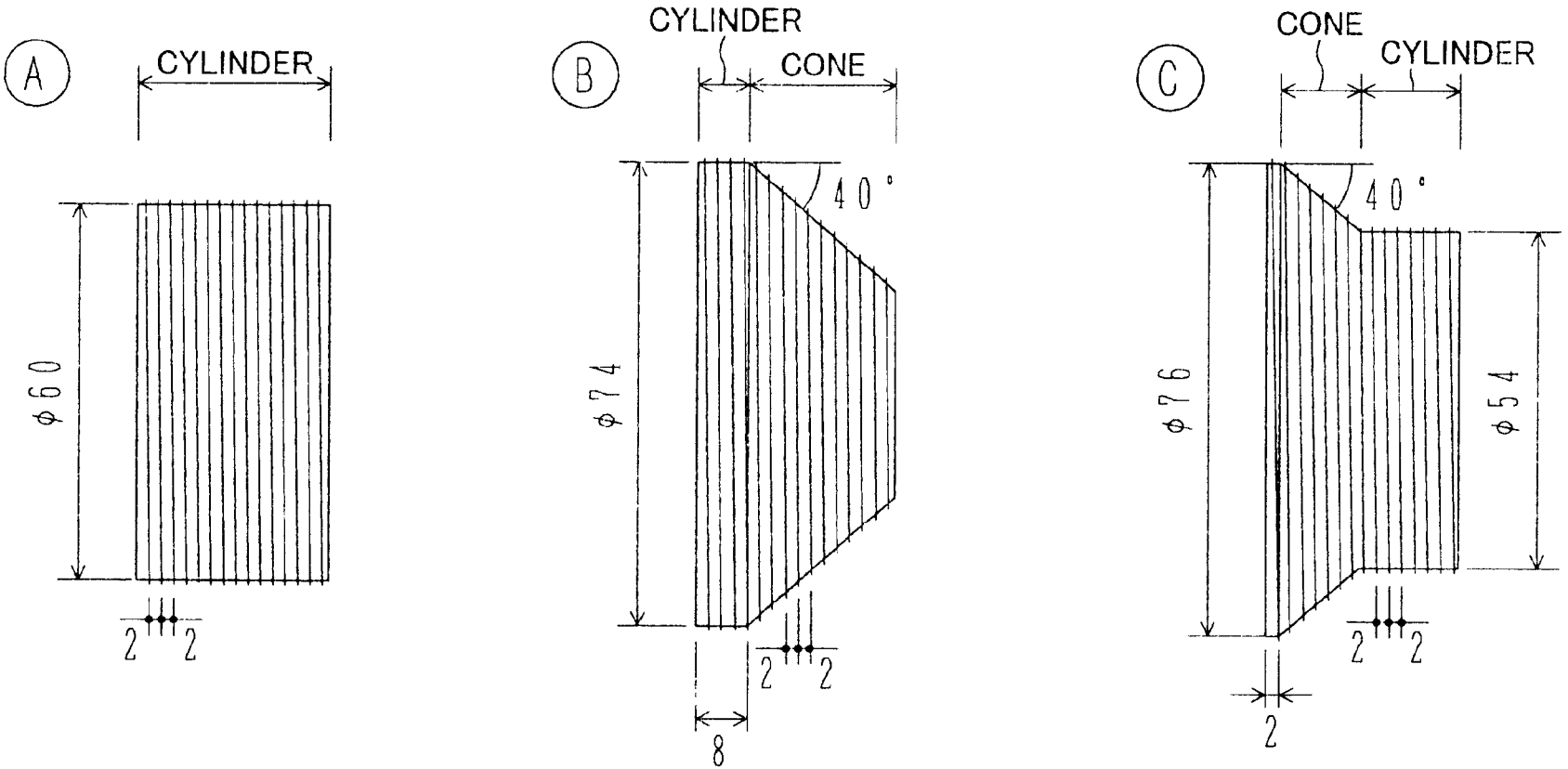
FIG. 9 is a view illustrating three types of shapes of second balance pulleys for comparing and examining the shapes.

First, the results of comparing and examining shapes of second balance pulleys will be described. Herein, the following three types of second balance pulleys shown in FIG. 9 are compared with one another.

A: cylindrical shape in whole length

B: conical shape+cylinder in the order from the right in the drawing (according to Japanese Patent Application No. Hei-7-254751)

C: cylinder+conical shape in the order from the right in the drawing (according to the present invention)

All the three types of second balance pulleys are for steel slat shutters. Each of these three types of second balance pulleys was connected to a coil spring, and the relationship between the rotation speed of the coil spring (the rotation speed of the second balance pulley), coil spring torque and a wire tensile force was examined. The following conditions were provided to ensure proper performance comparison.

coil spring rotation speed: 15 rotations (the same)

effective length of the tension wire: about 2,800 mm (the same)

inclination of the cones in Type B and Type C: 40° (the same)

pitch of the spiral groove: 2 mm (the same)

In addition, the sizes of the three types of second balance pulleys were as follows.

Type A is a cylindrical shape with diameter of 60 mm

Type B is a conical shape with inclination of 40°+a cylindrical shape with diameter of 74 mm and length of 8 mm Type C is a cylindrical shape with diameter of 54 mm +a conical shape with diameter of 76 mm and inclination of 40°

On the other hand, the following coil spring was used as the coil spring of the spring unit.

wire size (d): diameter of 4.5 mm coil size (D): diameter of 50 mm number of turns (N): 260 torque at the time of 15 rotations=975 Kg·mm

Figure 11:
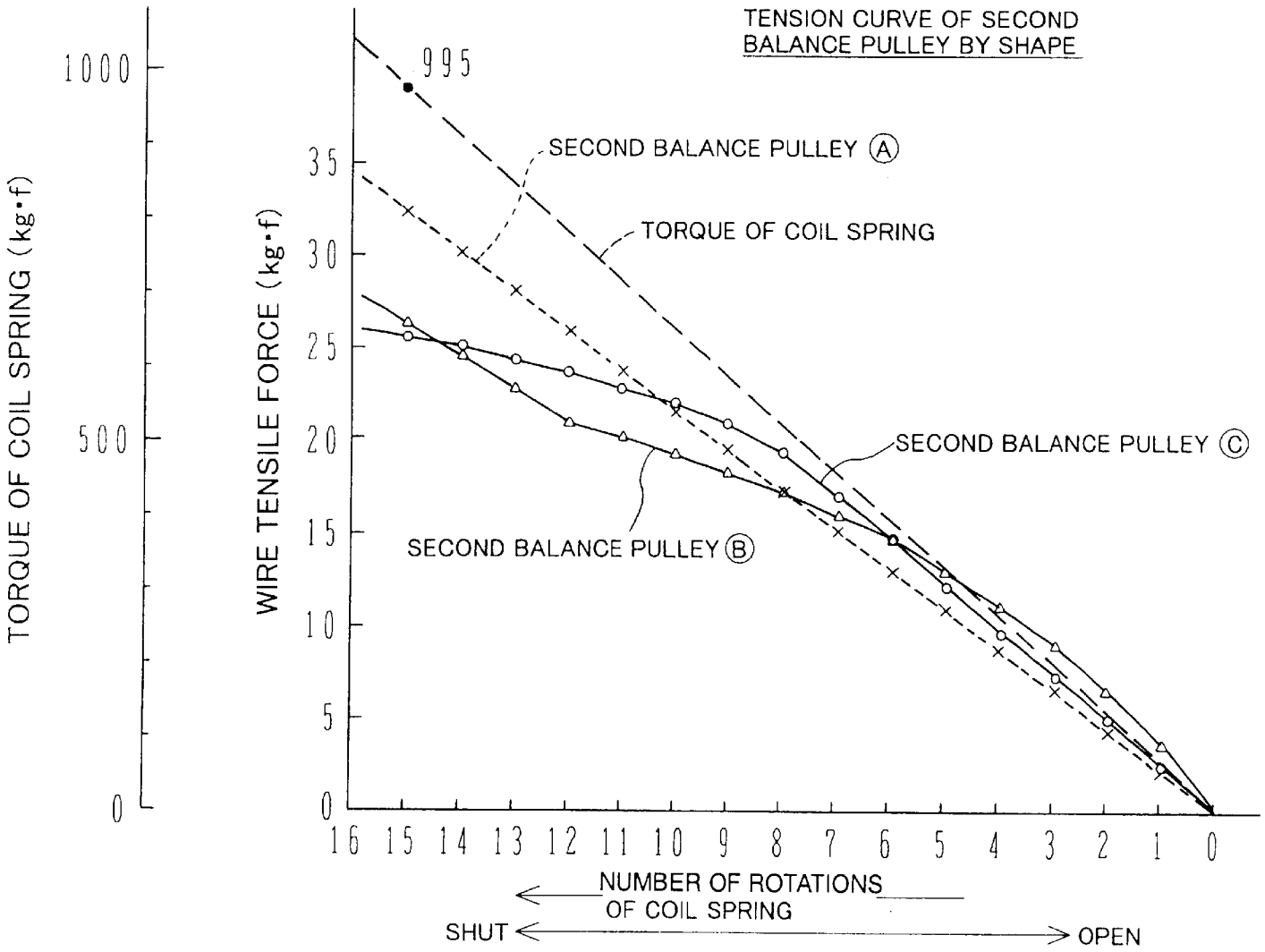
FIG. 11 is a graph showing the calculated values shown in FIG. 10.
Figure 12:
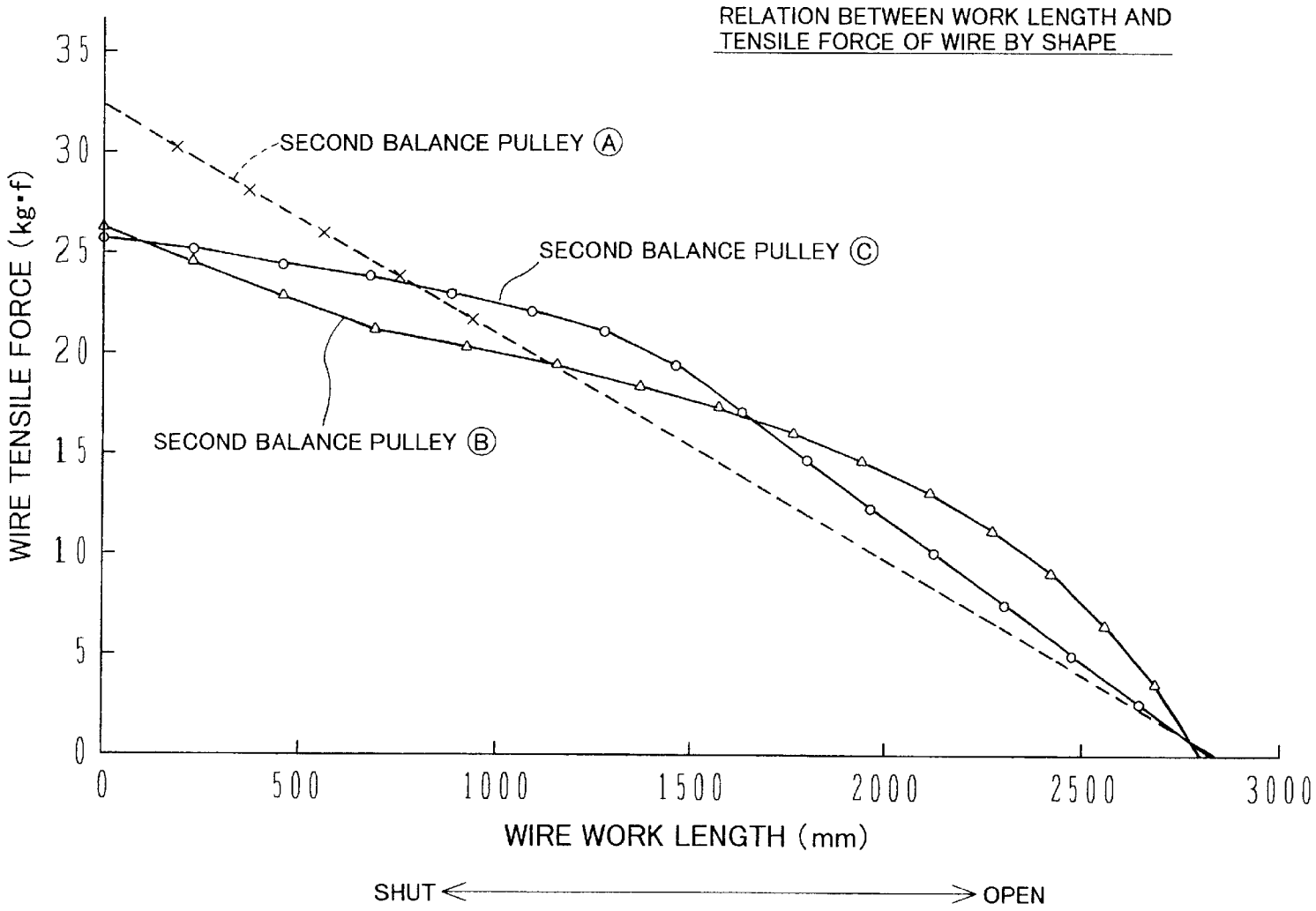
FIG. 12 is a graph reforming FIG. 11 into the relationship between the circumferential length of the tension wire and the tensile force.

Torque was calculated every rotation of the coil spring, and the calculated torque was divided by turning radius corresponding to each second balance pulley of the types A, B and C to thereby obtain a tensile force. The thus calculated tensile force was shown on a table in FIG. 10 and by graph in FIG. 11. In FIG. 12, FIG. 11 is modified to the relationship between the circumferential length of the tension wire and the tensile force in order to facilitate the comparison with hoisting drum torque.

Figure 13:
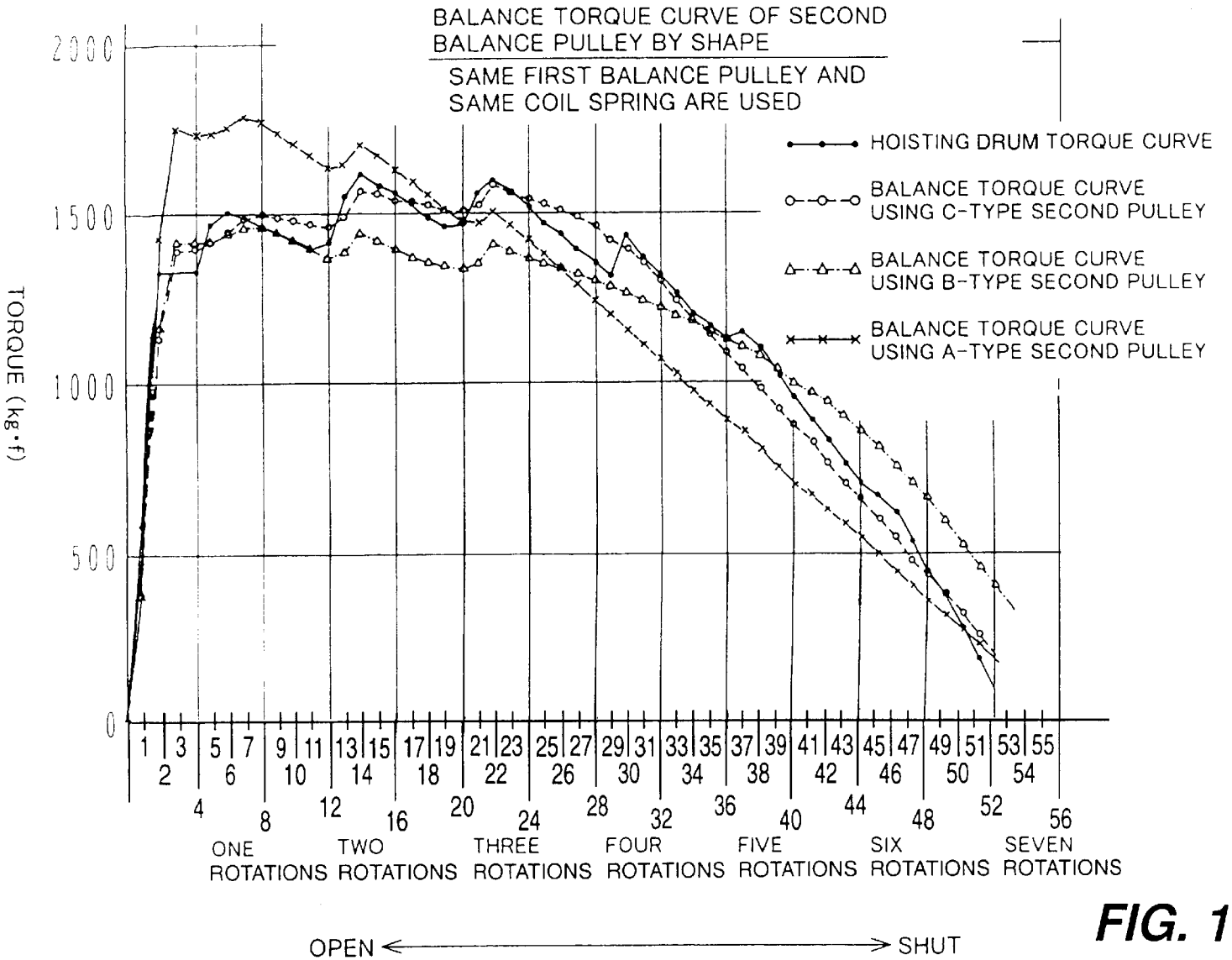
FIG. 13 is a graph showing a balance torque curve and a hoisting drum torque curve based on the three types of the second balance pulleys.

Further, in FIG. 13, balance torque was calculated by using the relationship in FIG. 12, and this calculated value was compared with real hoisting drum torque.

In the calculation of the balance torque shown in FIG. 13, the same first balance pulley with the following size as shown in FIG. 6 was used.

diameter of the main pulley portion: 140 mm secondary circle diameter of the zero-point return pulley portion: 130 mm tertiary circle diameter of the zero-point return pulley portion: 120 mm In addition, the same steel shutter with the following specification was used as the shutter.

shutter size: W (width) 2,850 mm×H (height) 2,300 mm slat unit weight: 5.5 Kgf/$m^2$ slat curtain weight: 36.1 Kgf air slit: nothing In the balance torque curve in FIG. 13, graduated in 45° rotation of the hoisting drum, torque obtained by the calculation of the wire tensile force shown in FIG. 12 and the effective diameter of the first balance pulley was plotted every graduation from the zero point of the fully shut position of the shutter (the position where the tension wire 50 passes the axial center 0 of the main pulley portion 25).

In the hoisting drum curve, actual measurement values were plotted every graduation of 45° rotations of the hoisting drum in-the same manner as described above.

The hoisting drum torque rises suddenly up to about 80% of the maximum torque on the second graduation (90°). Then, the hoisting drum torque forms a small mountain on the 6th graduation (¾ rotation), takes its maximum value on the 14th graduation (one and ¾ rotations), and takes the next highest value on the 22nd graduation (two and ¾ rotations). Thereafter, repeating some mountains, the hoisting drum torque goes down to the right, and reaches the fully opened state on the 51st graduation (6 and ⅜ rotations).

The following is understood from FIGS. 12 and 3 about the respective types of second balance pulleys.

Type C

FIG. 12 (wire tensile force):

(1) The type C pulley has the curve closest to the shape of the hoisting drum torque curve shown in FIG. 13.

(2) In addition, the tensile force at the zero point (fully shut position of the shutter) becomes minimum. This is a preferable condition because it is necessary to make the torque (balance torque) of the first balance pulley be zero at this position as mentioned above.

(3) The tensile force keeps a high value from the zero point to substantially the intermediate point (1,400 mm), thereafter goes down straightly to return to zero. This is a preferable shape correspondent to the hoisting drum torque curve.

FIG. 13 (balance torque):

(1) As a result, the balance torque of the type C follows the hoisting drum torque comparatively well so as to obtain a good result.

(2) The reason why the balance torque becomes zero at the zero point of the fully shut position is due to the above-mentioned action of the flat portion 26*b* of the zero-point return pulley portion 26 of the first balance pulley 20.

(3) The change of the balance torque till the 12th graduation (one and ½ rotations) is caused by the wire tensile force curve improved by the conical portion 47 of the second balance pulley 40 and the shapes of the flat portion 26*b* and the curved portion 26*a* of the zero-point return pulley portion 26 of the first balance pulley 20. The change of the balance torque thereafter is caused by the shapes of the conical portion 47 and the cylindrical portion 46 of the second balance pulley 40 and the shape of the cylindrical portion 23 of the first balance pulley 20. That is, the main pulley portion 25 of the first balance pulley 20 is different from the configuration having a conical portion in Japanese Patent Application No. Hei-7-254751, and the balance torque can be adjusted only by the cylindrical portion 23. Further, the balance torque can be fitted to a delicate curve of the hoisting drum torque by the shape of the curved portion 26*a*.

Type B

FIG. 12 (wire tensile force):

(1) It takes a considerably lower value than that of the type C in a range of from 400 mm to 1,400 mm in which the tensile force is the most necessary. This means that the force of the same coil spring is used only at a low efficiency. In order to obtain the same force as that in the type C, a coil spring which is one size larger is required.

(2) After 1,600 mm, it considerably projects upward in comparison with that of the type C. This does not meet the shape of the hoisting drum torque.

FIG. 13 (balance torque):

As a result, torque is insufficient in a range of from the 12th graduation (one and ½ rotations) to the 32nd graduation (4 rotations) in which the maximum torque is required. In addition, the torque becomes larger considerably on and after the 40th graduation (5 rotations), so that the state of balance is not good. If the torque is increased for the purpose of compensating the lack of torque in the intermediate portion, the torque in the latter half increases more and more. A similar thing occurs in the contrary case.

Type A

FIG. 12 (wire tensile force):

(1) The tensile force from the zero point to the 500 mm point is much larger than that of any other types. This makes it difficult to design the first balance pulley, and causes the reduction of the safety factor of the tension wire.

(2) The force is insufficient in a range of from 800 mm to 1,400 mm in which enough force is required.

FIG. 13 (balance torque):

As a result, being out of the question, the torque projects in a range from the zero graduation to the 14th graduation (one and ¾ rotations), while the torque decreases on a large scale after the 24th graduation (3 rotations).

As has been described above, the shape of the type C is the most preferable, and in cooperation with the ideal shape of the first balance pulley, it is possible to use the force of the coil spring most effectively and to perform accurate balance.

Figure 14:
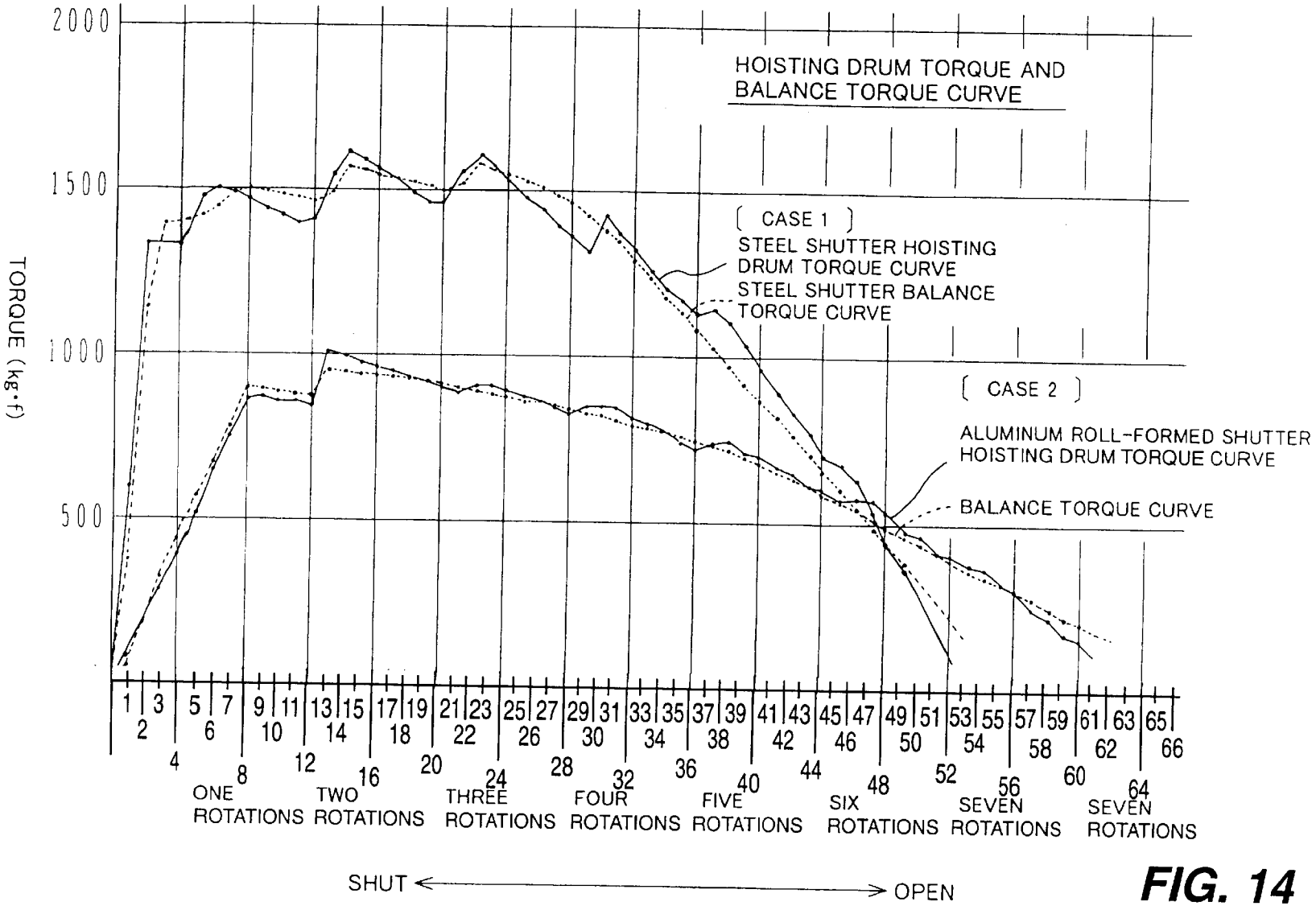
FIG. 14 is a graph showing a balance torque curve and a hoisting drum torque curve in the case where the present invention is applied to a steel shutter and an air-slit shutter.

FIG. 14 shows curves of hoisting drum torque and balance torque in the same manner as in FIG. 13 in which the present invention is applied to different kinds of shutters.

In FIG. 14, a case 1, in the case according to the above embodiment in which the present invention was applied to a shutter using a steel slat, has the same curves as the hoisting drum torque and the balance torque of the type C shown in FIG. 13.

Figure 15A:
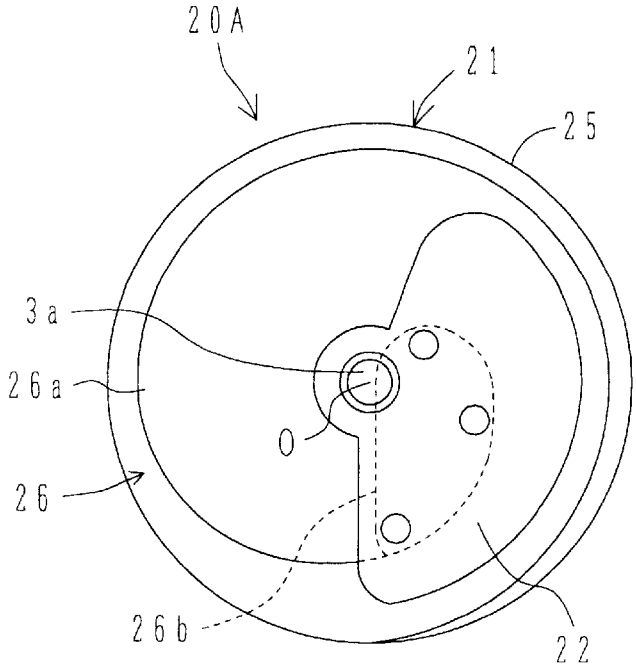
FIG. 15A is a front view illustrating the shape of the first balance pulley when the present invention is applied to an air-slit shutter.
Figure 15B:
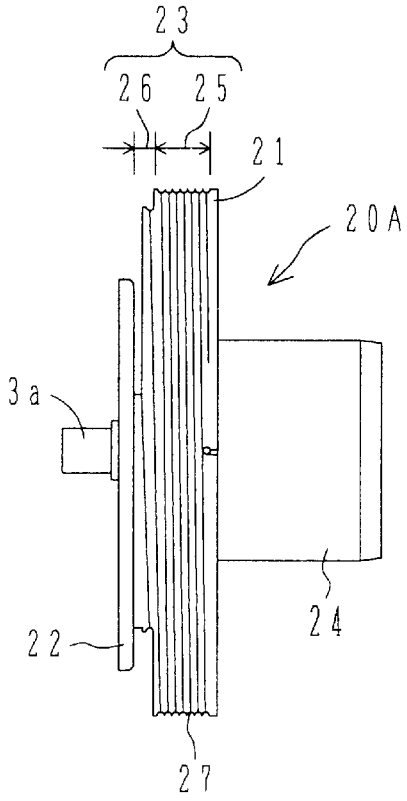
FIG. 15B is a side view illustrating the shape of the first balance pulley when the present invention is applied to an air-slit shutter.
Figure 16:
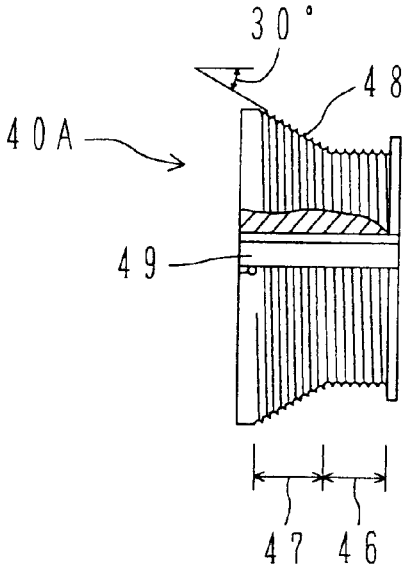
FIG. 16 is a side view illustrating the shape of the second balance pulley when the present invention is applied to an air-slit shutter.

A case 2, in the case where the present invention was applied to a shutter using an aluminum roll-formed slat of an air-slit type, uses a first balance pulley and a second balance pulley having shapes shown in FIGS. 15 and 16. In the drawings, the first balance pulley and the second balance pulley as a whole are designated by the reference numerals 20A and 40A, and their respective parts are referenced correspondingly to those shown in FIGS. 6 and 7.

In addition, an aluminum roll-formed shutter having the following specification was used as the shutter.

shutter size: W (width) 2,850 mm×H (height) 2,300 mm slat unit weight: 3.4 Kgf/m$^2$ slat curtain weight: 22.3 Kgf air slit: exist inter-slat movement: 3.5 mm In the case 1, as described in FIG. 13, the hoisting drum torque rises suddenly up to about 80% of the maximum torque on the second graduations (90°). Then, the hoisting drum torque forms a small mountain on the 6th graduation (¾ rotation), takes the maximum value on the 14th graduation (one and ¾ rotations), and takes the next highest value on the 22nd graduation (two and ¾ rotations). Thereafter, repeating some mountains, the hoisting drum torque goes down to the right, and reaches the fully opened state on the 51st graduation (6 and ⅜ rotations).

In the case 2, the hoisting drum torque rises straight to the 8th graduation (1 rotation), and comes into a substantially flat state after reaching the value of about 85% of the maximum torque. Passing the 12th graduation (one and ½ rotations), the hosting drum torque rises suddenly, and reaches the maximum value on the 13th graduation (one and ⅝ rotations). Thereafter, repeating some mountains, the hoisting drum torque goes down while drawing a gentle parabola declining to the right, and reaches a fully opened state on the 61st graduation (7 and ⅝ rotations).

The difference in the graduation at the fully opened position between the case 1 and case 2 depends on the presence/absence of the air slit. In addition, the peak in either curve appears in the position where the first slat is taken up around the hoisting drum. The shape of the mountain of the hoisting drum torque changes more or less in accordance with the shape of the hoisting drum.

It is understood from FIG. 14 that the balance torque changes while substantially meeting the delicate curve of the hoising drum torque in either case of the case 1 and the case 2.

Then, as mentioned above, the change of the balance torque to the 12th graduation (one and ½ rotations) is caused by the wire tensile force curve improved by the conical portion 47 of the second balance pulley 40 and the shapes of the flat portion 26*b* and the curved portion 26*a* of the zero-point return pulley portion 26 of the first balance pulley 20. The balance torque can be adjusted to meet the delicate curve of the hoisting drum torque by the shape of the curved portion 26*a*. The change of the balance torque after that is caused by the shapes of the conical portion 47 and the cylindrical portion 46 of the second balance pulley 40 and the shape of the cylindrical portion 23 of the first balance pulley 20.

As described above, in this embodiment, the conical portion 47 is provided in the second balance pulley 40 so that the wire tensile force curve is improved to approach the hoisting drum torque curve. Consequently, the difference between the hoisting drum torque and the balance torque is reduced all over the range of the shutter open/shut operation, so that there does not occur such a problem that the slat curtain is heavy immediately before the shutter is fully shut, and contrariwise, the slat curtain dashes immediately after the shutter is opened from the fully shut state. In addition, the shutter can be opened and shut quickly with a light operation force of about 3 to 4 kg.

Further, because the difference between the hoisting drum torque and the balance torque is reduced all over the range of the shutter open/shut operation, a smooth open/shut operation can be attained at any position of the shutter open/shut operation.

In addition, the wire tensile force curve is improved so that the shape of the main pulley portion 25 of the first balance pulley 20 can be made simple so as to have only a cylindrical portion, and the design can be changed easily for any sort of shutters such as an air-slit type shutter. Furthermore, even if the design is changed for another sort of shutter, for example, for an aluminum roll-formed shutter in such a manner, balance torque can be set so as to change while substantially meeting a delicate curve of hoisting drum torque, as shown in the case 2 of FIG. 14, in the same manner as in the case of the steel shutter (case 1). Accordingly, the operation property of the shutter can be made superior in the same manner as in the case of the steel shutter. That is, the balance pulley according to the present invention can be used in any sort of shutters, and have superior operation property.

Next, the operation rope unit 11 and a safety device relating thereto will be described in detail with reference to FIGS. 1, 2, and 17 to 21.

Figure 17:
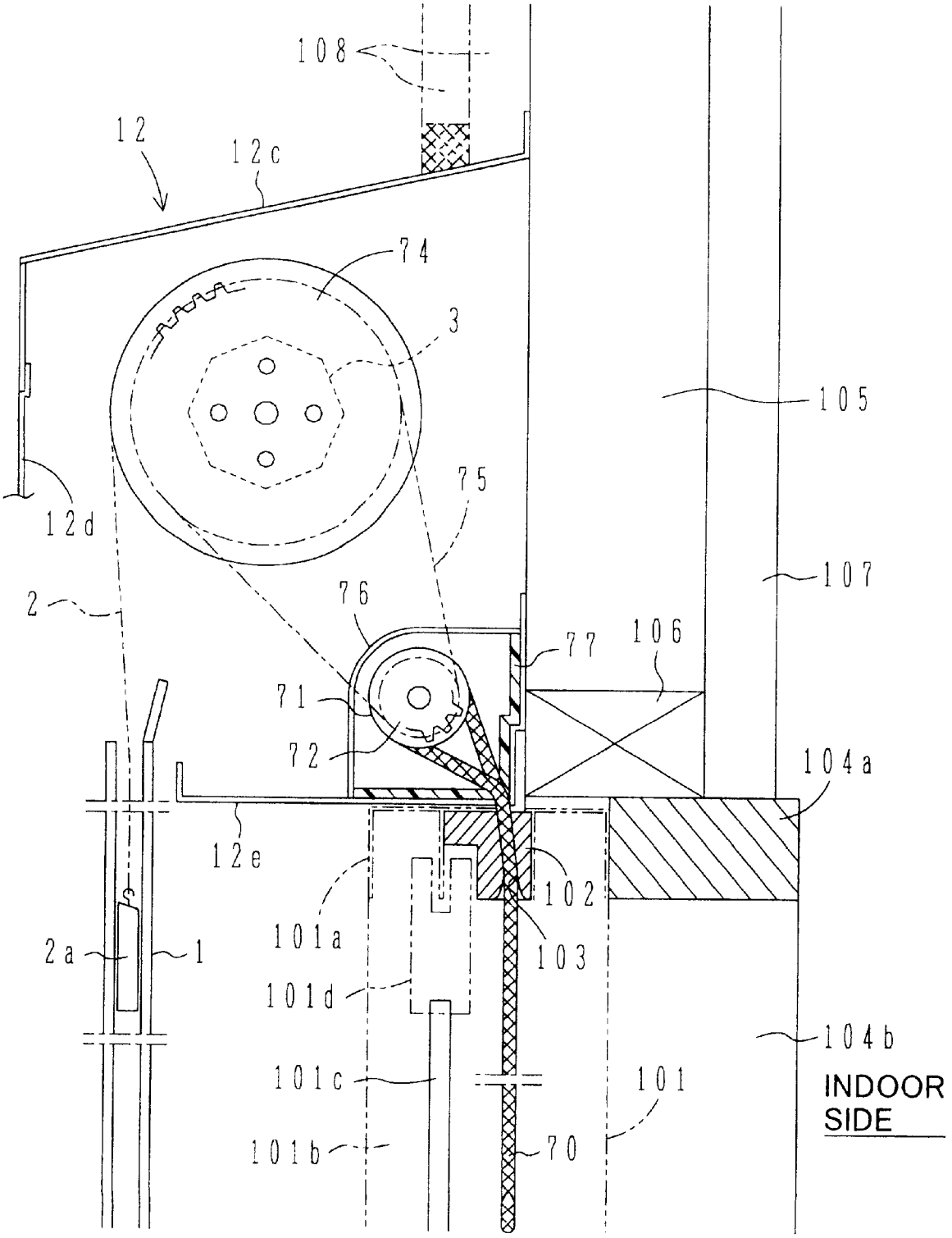
FIG. 17 is a view showing the state of pulling out an operation rope of an operation rope unit.

As shown in FIGS. 2 and 17, the operation rope unit 11 has an operation rope 70, a reverse rotation preventing device 73 having a rope pulley 71 around which the operation rope 70 is engaged and a small sprocket 72, a large sprocket 74 attached to the end cap 3*c* of the hoisting drum 3, and a roller chain 75 engaged around the small sprocket 72 and the large sprocket 74. A part of the operation rope 70 is introduced to the indoor side, and the operation rope 70 is operated on the indoor side, so that the hoisting drum 3 can rotate. The operation rope 70 is an endless rope made of synthetic fiber. The rope pulley 71 around which the operation rope 70 engages has a U- or V-groove, and this groove surface has a protrusive pattern to increase the frictional resistance with the rope (see FIG. 21).

The portion of the rope pulley 71 of the reverse rotation preventing device 73 is covered with a drip-proof cover 76. This drip-proof cover 76 is removably attached onto a sectionally L-shaped operation rope pedestal 77. The pedestal 77 is fixed to the shutter case 12 by machine screws.

In addition, a plastic door stop 102 provided in an upper frame 101*a* of a sash 101 is used in order to introduce the operation rope 70 to the indoor side. A through hole 103 is formed vertically in this door stop 102. Meeting this through hole 103, holes are formed through the pedestal 77, the bottom plate 12*e* of the shutter case 12, and the upper frame 101*a* of the sash 101. The operation rope 70 is passed through these holes, and introduced to the indoor side. The above-mentioned drip-proof cover 76 prevents rain water from entering the indoor side through these holes.

Figure 18:
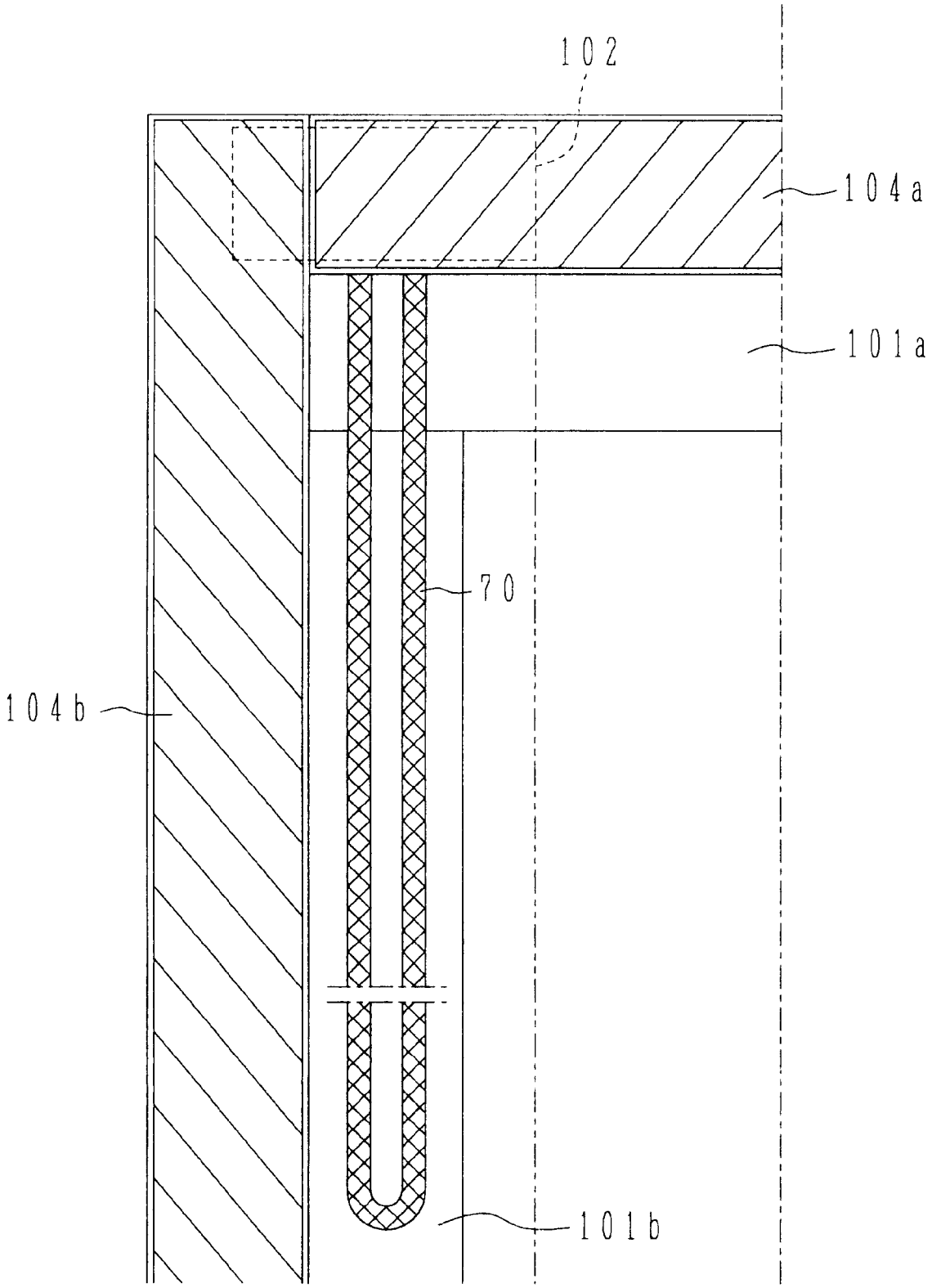
FIG. 18 is a view illustrating the operation rope, viewed from the indoor side.

FIG. 18 shows the operation rope 70 viewed from the indoor side. The operation rope 70 is hung in the left of the sash where the door stop 102 is provided.

Figure 19:
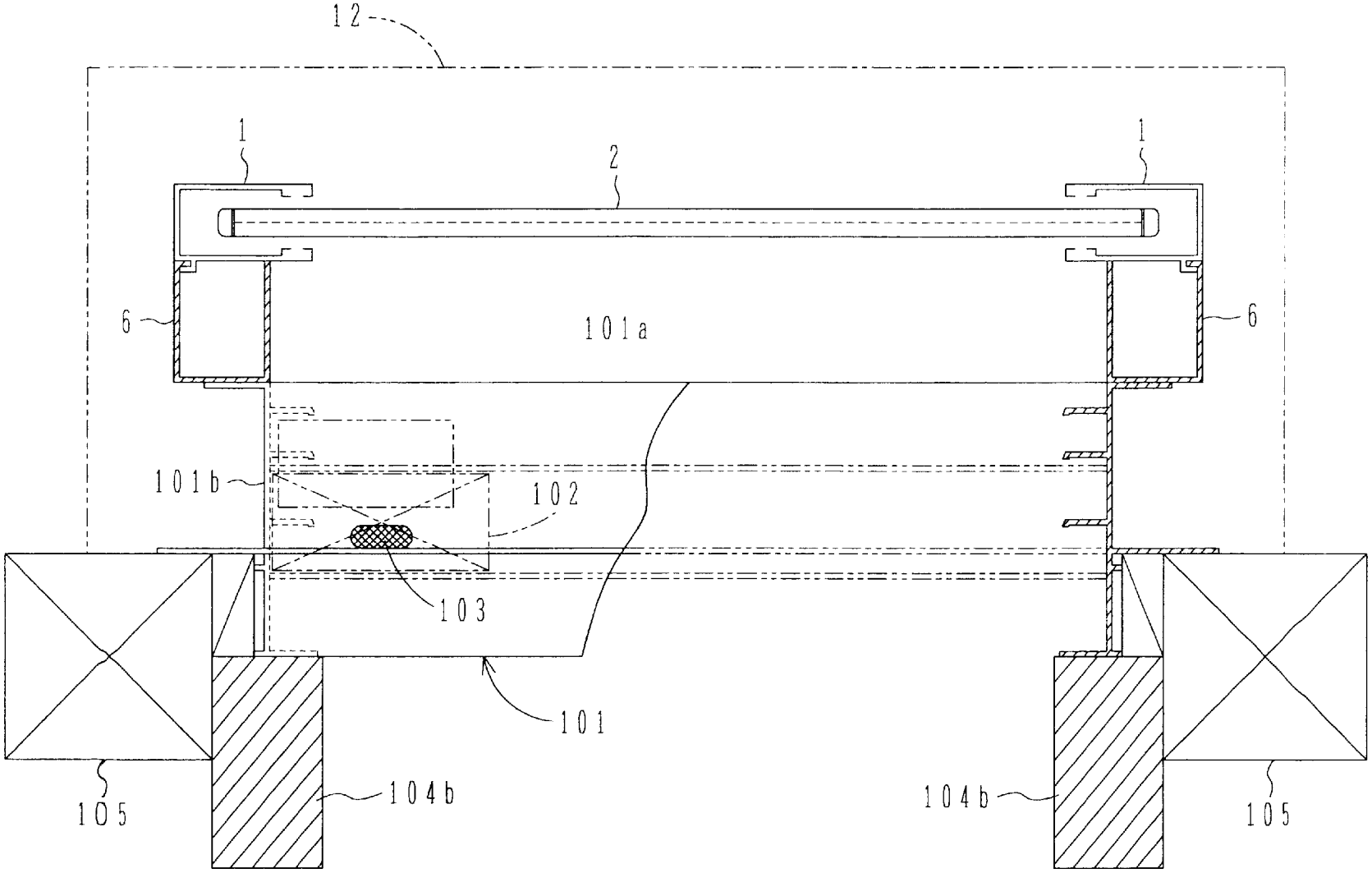
FIG. 19 is a view illustrating the upper surface of an upper frame of a sash, together with the position relationship of the shutter case and a slat curtain.

FIG. 19 shows the upper surface of the sash upper frame 101*a*, together with the positional relationship of the shutter case 12 and the slat curtain 2. The through hole 103 is formed in the door stop 102 provided in the sash upper frame 101*a*, and a hole is formed in the upper surface of the sash upper frame 101*a* so as to meet the through hole 103.

In FIGS. 2, 3, and 17 to 19, the reference numeral 101*b* represents a longitudinal frame of the sash; 101*c*, a sliding glass window; 101*d*, a sliding door frame; 104*a* and 104*b*, wooden decoration frames; 105, a pillar; 106, a crossbar; 107, an inner wall; and 108, an outer wall.

By leading-out the operation rope 70 to the indoor side by use of the sash door stop 102, the following advantages can be obtained.

The technique in which the operation rope is introduced into the indoor side is proposed in Japanese Patent Application No. Hei-7-254751. In this proposal, however, a rope wheel is attached to the other end of the hoisting drum, and the operation rope engages on the rope wheel and led out to the indoor side. In such a manner, though more or less different in accordance with the sort of sash or the like, there often arises such a case where a hole is formed in the pillar 105 and/or the inner wall 107 in the outside of the pillar 105. However, formation of a through hole for the operation rope in a building body such as a wall, a pillar or the like involves a problem in the structure of the building. Therefore, it has met a very large resistance. In addition, there are various problems in strength, appearance, construction, etc. in the case of the pillar. Further, because the position where the rope is led out is outside the sash attachment opening width (window), it is difficult to select the portion where the through hole for the operation rope is formed, and there occurs a problem concerning the convenience for right-handed and left-handed, when the shutter is attached to a window in a corner portion of the building.

In this embodiment, because the operation rope 70 is introduced to the indoor side by use of the door stop 102 of the sash 101 as mentioned above, the shutter can be installed without necessity to give any modification to the building body. In addition, installation is made simply so that there is no problem in strength and in appearance, and further, there arises no problem concerning the convenience for right-handed and left-handed.

The detailed structure of the reverse rotation preventing device 73 will be described with reference to FIGS. 20 and 21.

The reverse rotation preventing device 73 is provided as a safety device to transmit the rotation operation from the operation rope 70 to the hoisting drum 3 but not to transmit the rotation from the hoisting drum 3 to the operation rope 70 so as to prevent the rotation of the hoisting drum 3.

This reverse rotation preventing device 73 has two housing plates 83*a* and 83*b* separated by four (or three) spacer pipes (or rods) 81, installed and fixed onto the side plate 12*b* in the right of FIG. 2 by bolts 82. A shaft 85 is supported rotatably at the centers of these two housing plates 83*a* and 83*b* through bearings 84*a* and 84*b*. The above-mentioned small sprocket 72 is pin-connected to this shaft 85. In addition, a one-directional rotation transmitting mechanism 86 is provided between the housing plate 83*a* and the rope pulley 71 so that the shaft 85 is rotated by the rotations of the rope pulley 71, but not rotated by the rotations of the small sprocket 72.

Figure 21:
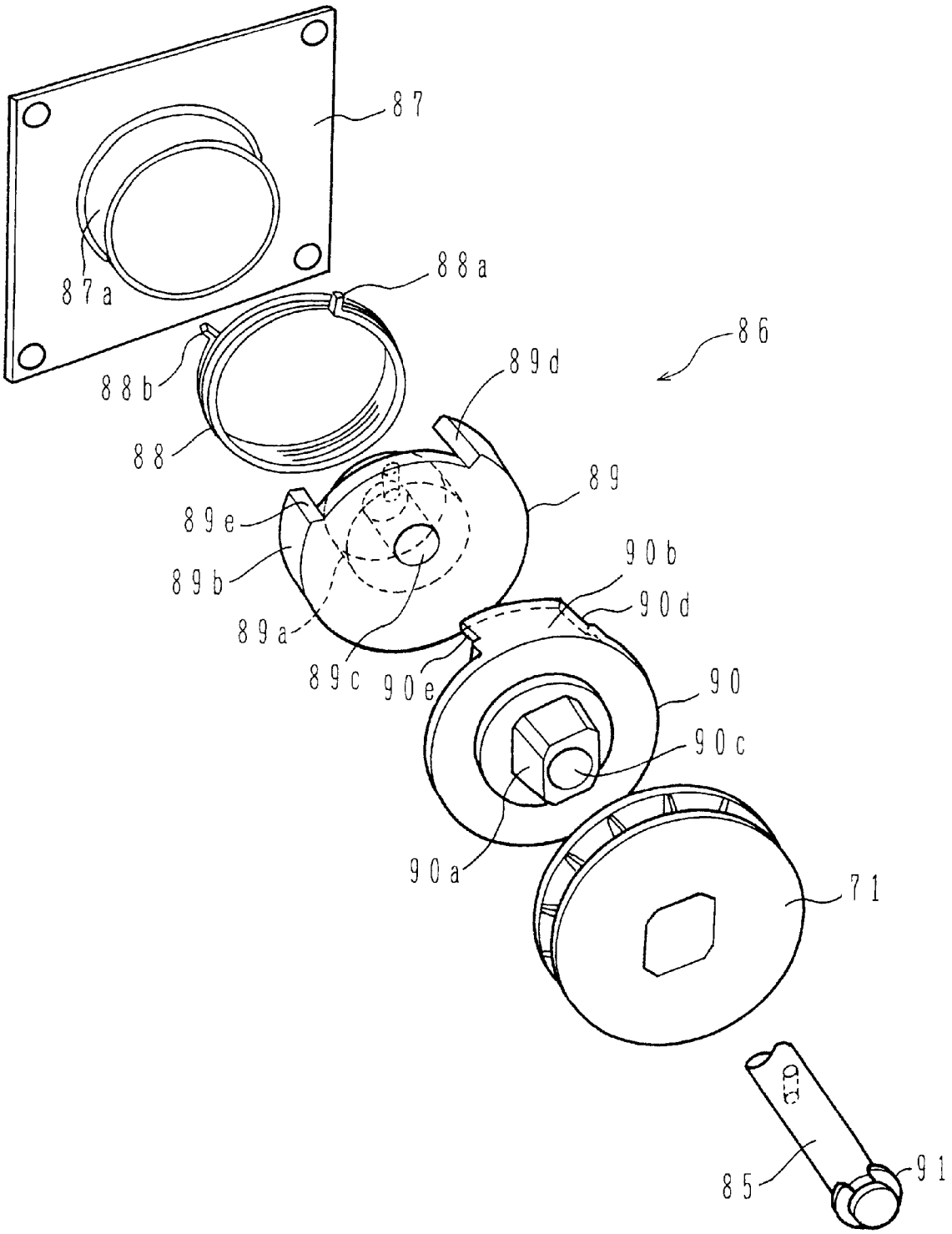
FIG. 21 is an exploded view illustrating in detail a one-directional rotation transmitting mechanism of the reverse rotation preventing device.

The one-directional rotation transmitting mechanism 86 has a body 87 attached by screws and fixed to the housing plate 83*a* as shown in FIG. 21. A clamping spring 88 is plugged into a cylindrical portion 87*a* of this body 87 with some tightness. An outer collar desk 89 and an inner collar desk 90 are assembled in a manner so that this clamping spring 88 is built in therebetween.

The clamping spring 88 is a coil spring having a square section with a plurality of turns. Two claws 88*a* and 88*b* projecting outward perpendicularly to the axial center at a predetermined angle, for example, an angle of 100° are provided on the opposite ends of the clamping spring 88.

The outer collar desk 89 has a cylindrical shaft portion 89*a* and an outer collar portion 89*b*. A through hole 89*c* is formed in the cylindrical shaft portion 89*a*. The shaft 85 passes this through hole 89*c*, and is brought into pin-connection. In addition, the cylindrical portion 87*a* of the body 87 and the clamping spring 88 gets into a recess portion between the cylindrical shaft portion 89*a* and the outer collar portion 89*b*. The outer collar portion 89*b* has outer collar end surfaces 89*d* and 89*e* separated at a predetermined angle larger than that of the two claws 88*a* and 88*b*, for example, at an angle of 120°. The two claws 88*a* and 88*b* are disposed between these outer collar end surfaces 89*d* and 89*e*.

The inner collar desk 90 has a square shaft portion 90*a* and an inner collar portion 90*b*. The square shaft portion 90*a* projects to the side opposite to the outer collar desk 89, and a through hole 90*c* is formed in this square shaft portion 90*a*. The shaft 85 passes this through hole 90*c* rotatably. In addition, the rope pulley 71 is plugged into the square shaft portion 90*a* rotatably integrally, and the axial positions of the square shaft portion 90*a* and the rope pulley 71 are held by a spring washer 91 provided in the front end of the shaft 85. The inner collar portion 90*b* projects to the outer collar desk 89 side, and has inner collar end surfaces 90*d* and 90*e* separated at a predetermined angle smaller than that of the two claws 88*a* and 88*b*, for example, at an angle of 80°. The inner collar portion 90*b* is inserted between the outer collar end surfaces 89*d* and 89*e* of the outer collar desk 89 and between the two claws 88*a* and 88*b*. In addition, the front end of the inner collar portion 90*b* abuts against the wall portion of the body 87.

Figure 20:
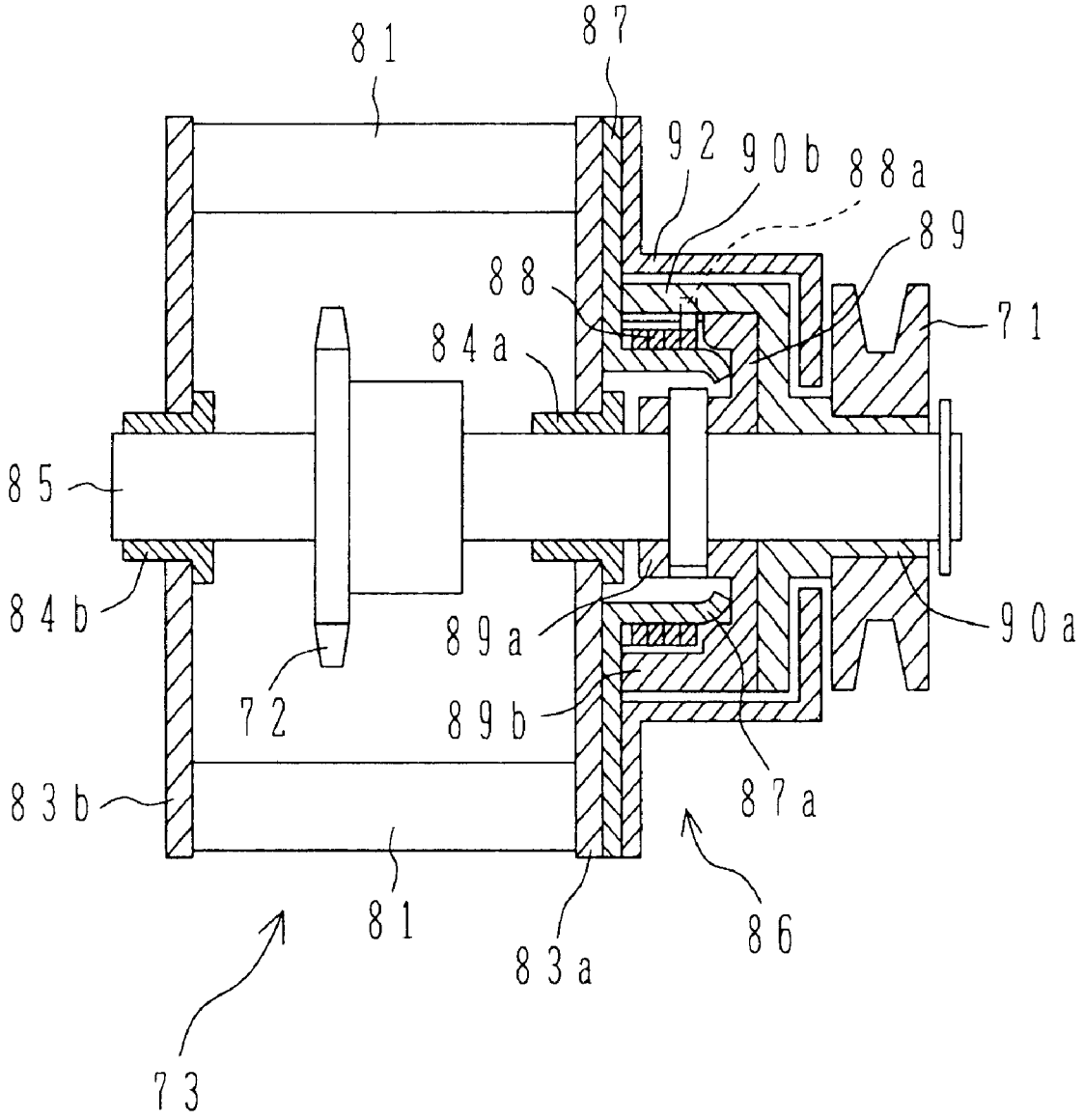
FIG. 20 is a sectional view of a reverse rotation preventing device.

A case cover 92 is provided in the outer circumferential side of the outer collar desk 89 and the inner collar desk 90 as shown in FIG. 20 so as to prevent leakage of grease charged into the clamping spring portion. The case cover 92 is attached by screws and fixed to the wall portion of the body 87.

The operation of the thus configured reverse rotation preventing device 73 will be described.

When the operation rope 70 is pulled in order to open or shut the shutter, the rope pulley 71 rotates clockwise or counterclockwise. This rotation rotates the inner collar desk 90 at the same time, so that one of the two inner collar end surfaces 90*d* and 90*e* of the inner collar portion 90*b* abuts against one of the two claws, 88*a* or 88*b*, of the clamping spring 88 to open the claw in the direction to increase the angle of 100° therebetween. Consequently, the clamping spring 88 is loosened to increase the inner diameter of the coil spring slightly. Accordingly, the clamping spring 88 which has been provided with some tightness can rotate relatively to the cylindrical portion 87*a* of the body 87, so that the rotation of the inner collar desk 90 is transmitted to the outer collar desk 89, and further transmitted from the outer collar desk 89 to the shaft 85, the small sprocket 72, the roller chain 75, and the large sprocket 74. Then, the hoisting drum 3 rotates.

On the other hand, when the hoisting drum 3 is rotated by a force from the outside, this rotation of the hoisting drum 3 is transmitted as a force to rotate the outer collar desk 89 through the large sprocket 74, the roller chain 75, the small sprocket 72 and the shaft 85. When the outer collar desk 89 rotates, one of the two outer collar end surfaces, 89*d* or 89*e*, of the outer collar portion 89*b* abuts against one of the two claws, 88*a* or 88*b*, of the clamping spring 88, acting in the direction to reduce the angle of 100° between the two claws 88*a* and 88*b*. Consequently, the clamping spring 88 is twisted in the clamping direction, so that the inner diameter of the coil spring is reduced, and the coil spring wound around the cylindrical portion 87*a* of the body 87 tightly so as to stop the rotation. Also in this case, the coil spring operates to stop any clockwise or counterclockwise rotation.

In such a manner, the rotation from the operation rope 70 side is transmitted to the hoisting drum 3, but the rotation from the hoisting drum 3 is blocked surely.

In the shutter 100 according to the present invention, the load of all the slats 4 is supported by one tension wire 50 in the fully opened position of the shutter. Though this wire 50 is of high quality and of high safety, the slat curtain 2 would drop by gravity if no countermeasure is taken when the wire 50 is cut off for some reason. Because the upper end of the curtain 2 is fixed to the hoisting drum 3, the lower end of the curtain 2 would collide against the lower frame 5.

In this embodiment, the reverse rotation preventing device 73 operates in the case as mentioned above so as to block the rotation of the hoisting drum 3. Accordingly, the slat curtain 2 is prevented from gravity-drop so that the safety is ensured.

Next, a shutter according to a second embodiment of the present invention will be described with reference to FIGS. 22 to 32. In this embodiment, the present invention is applied to a steel shutter.

At first, the whole configuration of the shutter according to this embodiment will be described with reference to FIG. 22 and FIGS. 23 to 26.

Figure 22:
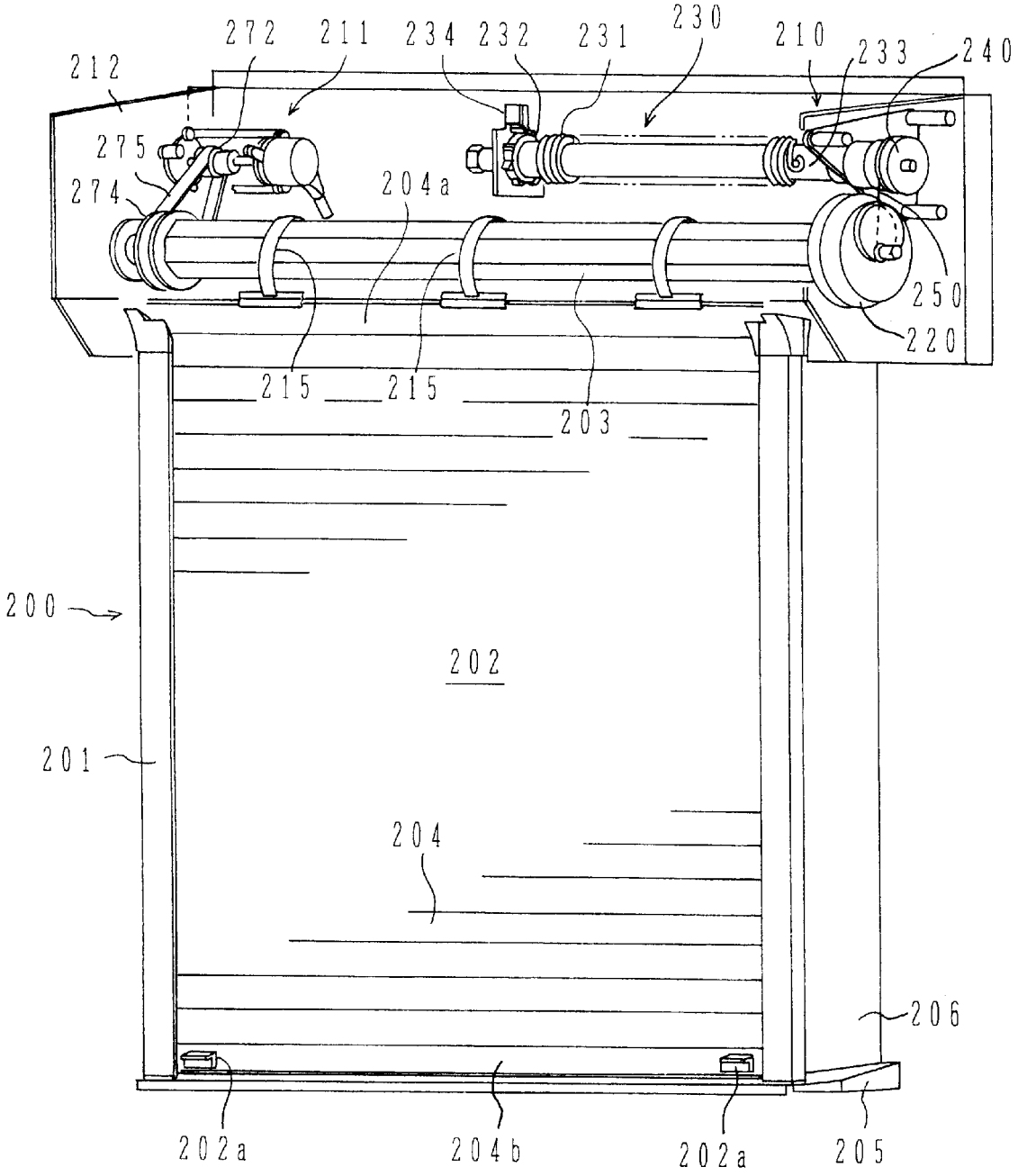
FIG. 22 is a perspective view of a balanced shutter according to a second embodiment of the present invention, wherein a part (a side plate and a front plate) of a shutter case and a part of a balancing device are cut away.

In FIG. 22, a balanced shutter 200 in this embodiment has a pair of right and left guide rails 201 and 201 erected a in parallel with each other and at a predetermined distance, a slat curtain 202 moved up and down under the guidance of these guide rails 201 and 201, a hoisting drum 203 for taking-up and feeding-out this slat curtain 202, a balancing device 210 provided on one end side of the hoisting drum 203, an operation rope unit 211 provided on the other end side of the hoisting drum 203, and a shutter case 212 for storing the hoisting drum 203, the balancing device 210, and shutter side parts of the operation rope unit 211.

In the slat curtain 202, a large number of steel slats 204, 204, . . . including an upper end slat 204*a* and a lower end slat 204*b* are connected to each other on their long sides flexibly so as to be made into a sheet of curtain. The upper end slat 204*a* is connected to the hoisting drum 203 through band-like lifting hooks 215, 215, . . . Stoppers 202*a* are provided on the opposite sides, respectively, of the lower end slat 204*b*. The reference numeral 205 represents a lower frame; and 206, a longitudinal frame.

Figure 23:
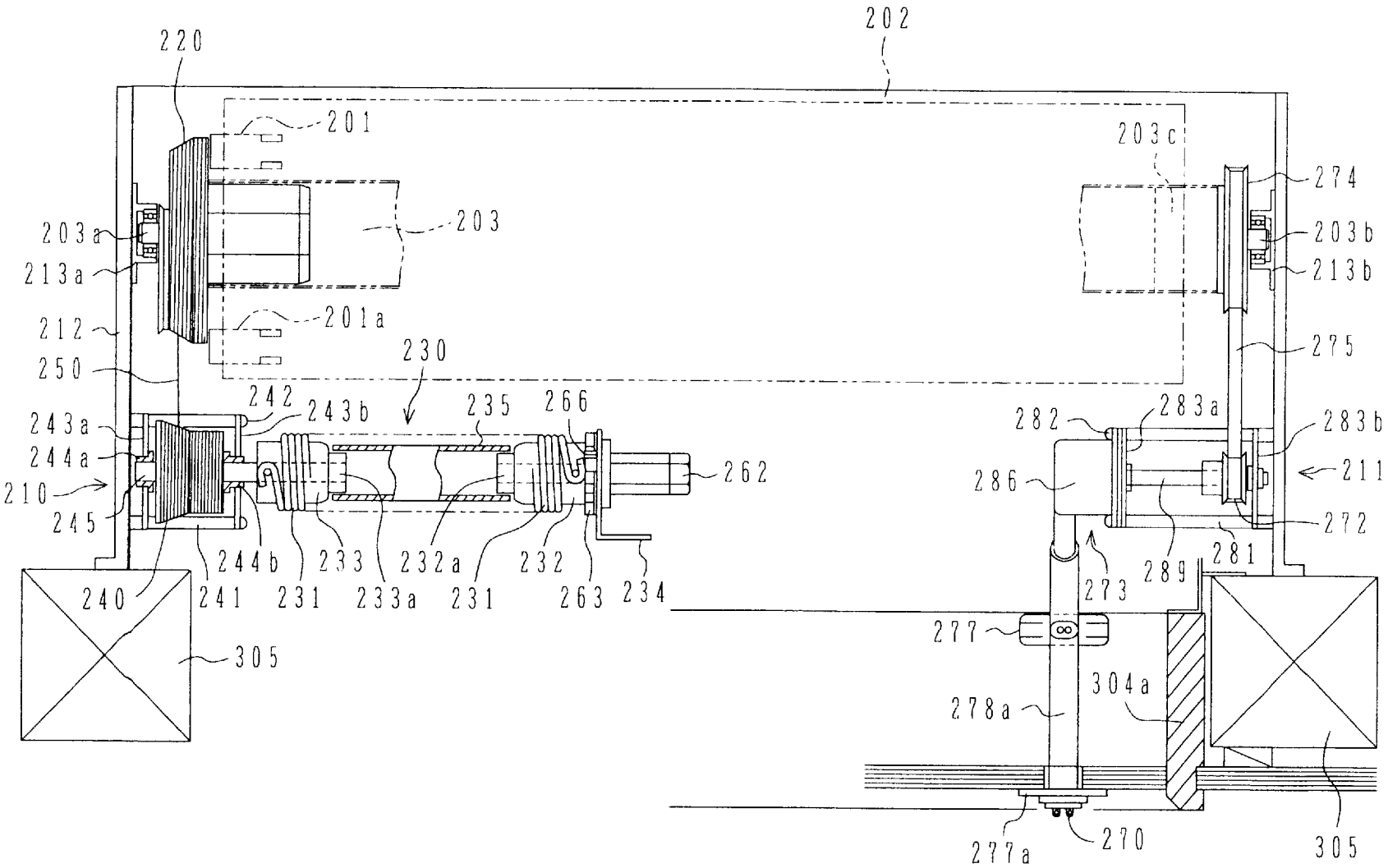
FIG. 23 is a plan view of the inside of the shutter case of the shutter shown in FIG. 22, wherein an upper plate of the shutter case is cut away, and a part thereof is illustrated sectionally.
Figure 24:
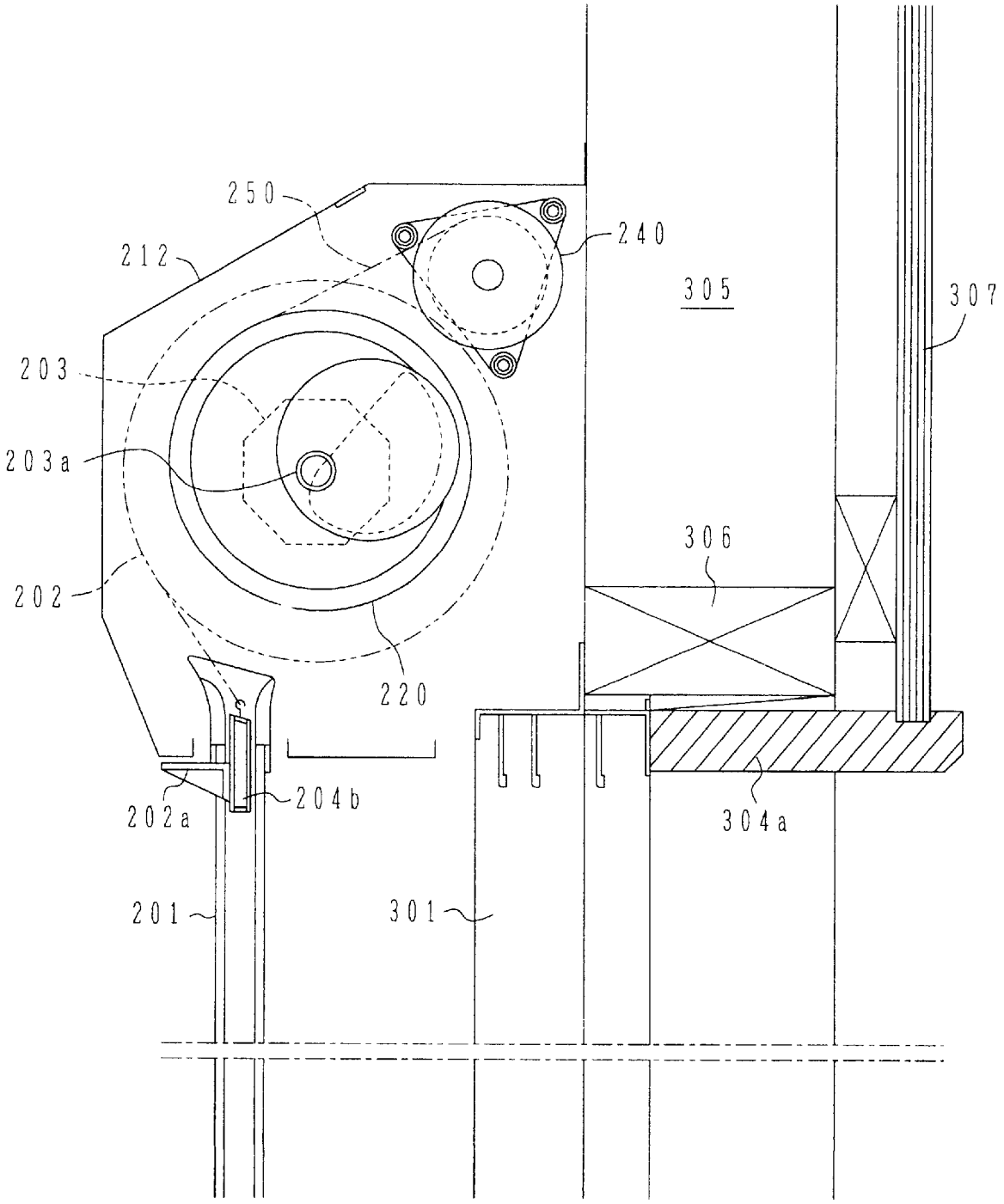
FIG. 24 is a side view of the fully opened state of the shutter shown in FIG. 22, wherein the side plate is mostly cut away.
Figure 25:
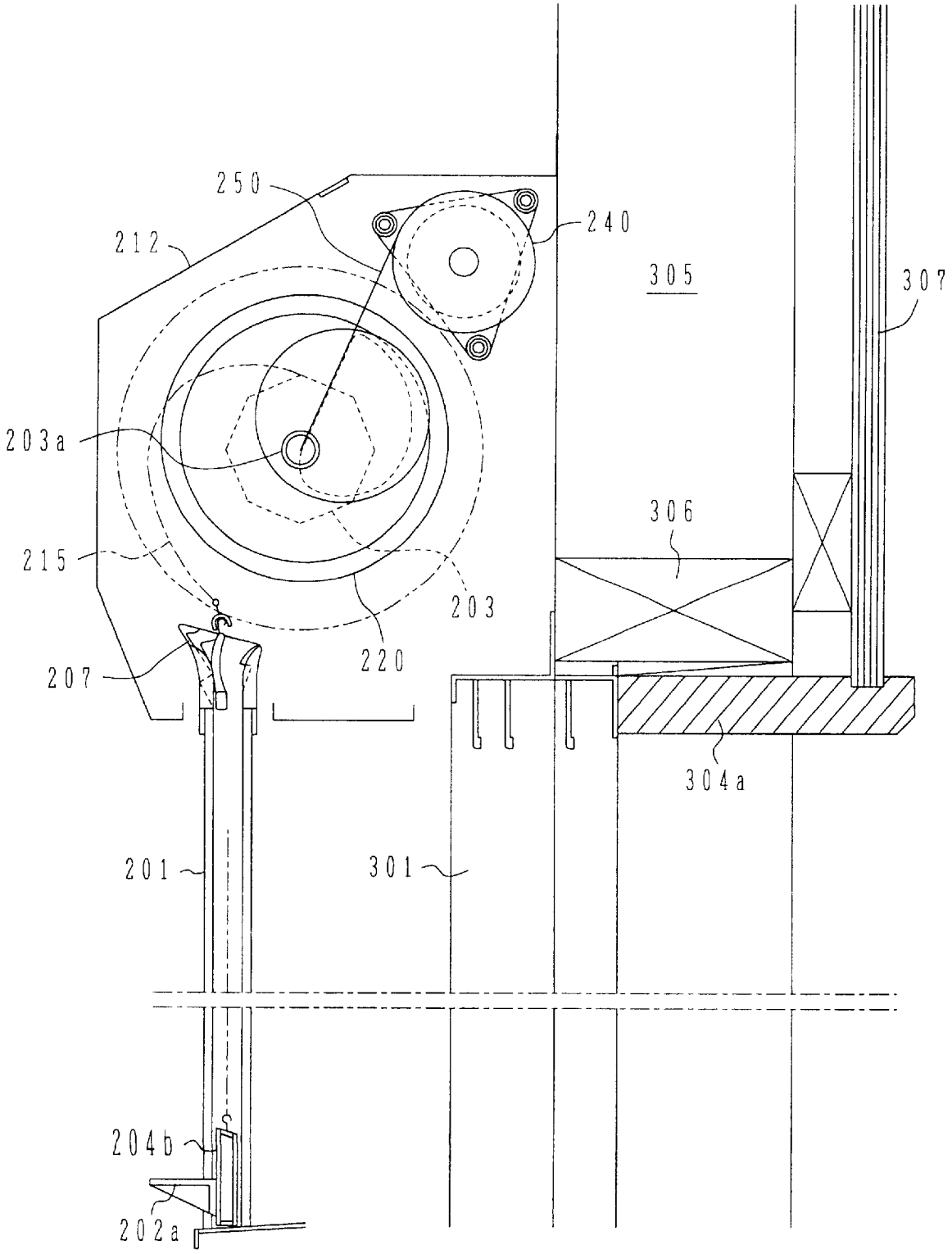
FIG. 25 is a side view of the shutter shown in FIG. 22 in the fully shut state, wherein the shutter case is cut away.

As shown in FIGS. 23 to 25, bearings 213*a* and 213*b* are provided in the inside of the side plates of the shutter case 212. The hoisting drum 203 is supported rotatably by these bearings 213*a* and 213*b*.

The hoisting drum 203 is made of an octagonal steel pipe in this embodiment. A first pulley 220 is plugged into an end portion of the hoisting drum 3 and fixed thereto by a machine screw as illustrated in the left of FIG. 23, while an end cap 203*c* is attached, in the same manner, to the other end portion of the hoisting drum 3 as illustrated in the right of FIG. 23. Rotation shafts 203*a* and 203*b* are provided at the centers of the first pulley 220 and the end cap 203*c* respectively. These rotation shafts 203*a* and 203*b* are inserted into the bearings 213*a* and 213*b*, respectively, so that the hoisting drum 203 is supported rotatably. The first balance pulley 220 constitutes a portion of the balancing device 210. The hoisting drum 203 is not limited to the octagonal steel pipe, and it may be formed into any other shapes and may be made from any other materials.

The lifting hook 215 consists of spring steel. In addition, a stopper 207 for preventing the upper end slat 204*a* displaced by the elasticity of the spring steel of the lifting hook 215 from moving upward in the fully shut position where the slat curtain 202 is fed out thoroughly is provided away from the hoisting drum 203 at the upper end of the rail guide 201, as shown in FIG. 25.

The balancing device 210 has a spring unit 230 supported by the side plates and the bottom in the corner on the body side of the upper portion of the shutter case 212. This spring unit 230 has a coil spring 231 for accumulating spring torque corresponding to the quantity of rotations of the hoisting drum 203 when the slat curtain 2 is fed out, and a second balance pulley 240 disposed adjacently to the first balance pulley 220 and connected to one end of the coil spring 231. A stainless steel tension wire 250 is provided between the first balance pulley 220 and the second balance pulley 240 so that one end of which is connected to the first balance pulley 220 while the other end is connected to the second balance pulley 240. The first balance pulley 220 is made to have a diameter larger than that of the second balance pulley 240.

The spring unit 230 has two housing plates 243*a* and 243*b* separated by four (or three) spacer pipes (or rods) 241, installed by bolts 242 onto the side plate of the shutter case 212 in the left of FIG. 23. A shaft 245 is supported rotatably at the centers of these two housing plates 243*a* and 243*b* through bearings 244*a* and 244*b*. The above-mentioned second balance pulley 240 is key-connected to this shaft 245.

In addition, the spring unit 230 has a fixed boss 232 and a rotary boss 233 to which the opposite ends of the coil spring 231 are fixed respectively. The fixed boss 232 is supported, by a pedestal 234, on the back plate of the shutter case 212 and the rotary boss 233 is connected integrally with the shaft 245. Small-diameter stepped portions 232*a* and 233*a* are formed in opposite portions of the fixed boss 232 and the rotary boss 233 respectively. A spring holding pipe 235 the opposite ends of which are plugged into these stepped portions 232*a* and 233*a* respectively is laid between the fixed boss 232 and the rotary boss 233. The coil spring 231 is held horizontally by this pipe 235.

Figure 26A:
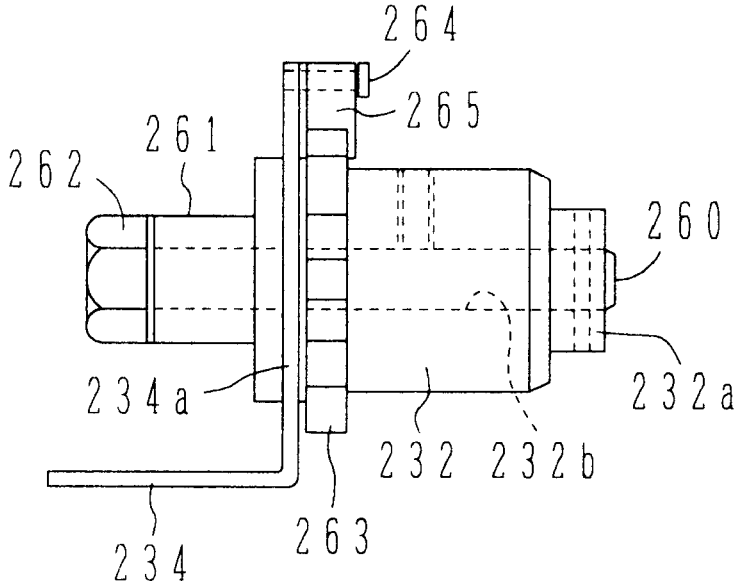
FIG. 26A is a side view illustrating a fixed boss with a ratchet in a spring unit.
Figure 26B:
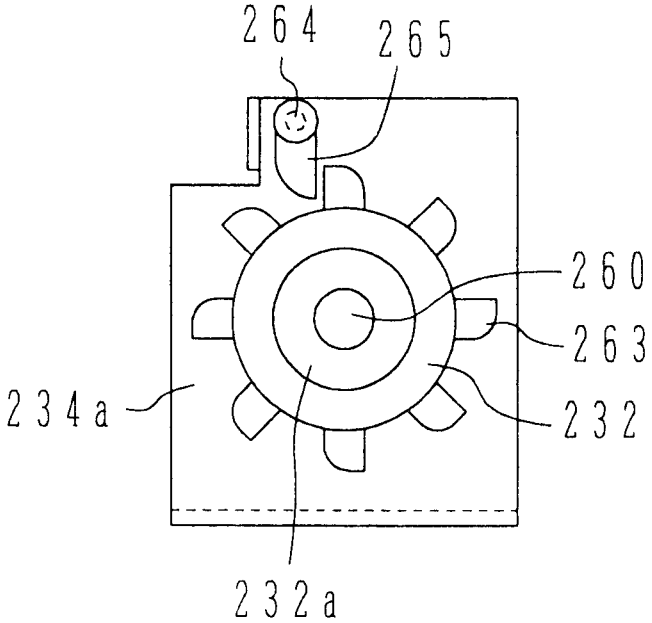
FIG. 26B is a front view illustrating a fixed boss with a ratchet in a spring unit.

The fixed boss 232 has a ratchet. As shown in FIG. 26, a hole 232*b* is formed at the center of the fixed boss 232. A shaft 260 is inserted into this hole 232*b*, and the fixed boss 232 is pin-connected to the shaft 260 in the stepped portion 232*a*. In addition, the pedestal 234 is formed into an L-shape. A bearing metal 261 is attached by screws to a leading edge portion 234*a* of the pedestal 234 on the opposite side to the fixed boss 232. The shaft 260 extends while penetrating the pedestal 234 and the bearing metal 261, and a bolt head 262 is attached to its end portion projecting from the bearing metal 261. Further, a ratchet 263 is cut in an end portion of the fixed boss 232 abutting against the pedestal 234, and a claw 265 is rotatably attached to the upper portion of the leading edge portion 234*a* of the pedestal 234 by a check pin 264. Further, a check plate 266 formed by bending a portion of the pedestal 234 is provided at the rear of the claw 265. These check plate 266, claw 265 and ratchet 263 prevent the fixed boss 232 from rotating counterclockwise in FIG. 26, and allow the fixed boss 232 to rotate clockwise because the ratchet 263 pushes the claw 265 up.

In the state shown in FIG. 24, the guide rails 201 are disposed on the outdoor side of the hoisting drum 203. The system in which slats guided by the guide rails 201 are taken up around the hoisting drum 203 when the positional relationship shown in FIG. 24 is set between the guide rails 201 and the hoisting drum 203 is called "involute". In the involute system, as to the winding direction of the first pulley 220, the second pulley 240 and the spring 231, those which are left hand winding viewed from the left in FIG. 23 are used.

On the other hand, a guide rail 201*a* shown in FIG. 23 is disposed on the indoor side of the hoisting drum 203. Such a system is called "revolute". In the revolute system, as to the winding direction of the first pulley 220, the second pulley 240 and the spring 231, it is necessary to use those which are right hand winding viewed from the left in FIG. 23.

The operation rope unit 211 is disposed in the right of FIG. 23 viewed from the indoor side, as shown in FIG. 23.

The operation rope unit 211 has a large pulley 274, a small pulley 272, a timing belt 275 laid between the large pulley 274 and the small pulley 272, a reverse rotation preventing device 273 connected to the small pulley 272, a rope pulley provided adjacently to the reverse rotation preventing device 273, and an operation rope 270 engaged on the rope pulley.

The large pulley 274 and the small pulley 272 are connected to each other by the timing belt 275. The small pulley 272 is fixed to an operation unit shaft 289. The operation unit shaft 289 is rotatably supported by housing plates 283*a* and 283*b*. The housing plates 283*a* and 283*b* are disposed at a predetermined distance by spacer pipes 281. A cover 286 is fixed to the left side of the housing plate 283*a*, and the reverse rotation preventing device 273 and the operation rope pulley are stored in the inside of the cover 286. The operation rope 270 is engaged around the operation rope pulley. The reverse rotation preventing device 273 and the operation rope pulley are connected to the operation unit shaft 289. Instead of the large pulley 274, the small pulley 272 and the timing belt 275, a large sprocket, a small sprocket and a roller chain may be used respectively.

The reverse rotation preventing device 273 has a mechanism to transmit an operation force transmitted from the operation rope 270 to the small pulley 272, but not to transmit a rotation force from the small pulley 272 side to the operation rope pulley side. The detailed structure of the reverse rotation preventing device 273 is the same as that described in FIGS. 20 and 21.

The operation rope 270 is an endless rope, which is engaged on the operation rope pulley and introduced to the indoor operation side through a duct 278.

The whole operation of the thus configured shutter 200 and the basic operation of the balancing device 210 are as follows.

At the fully opened position, the shutter 200 is in the state shown in FIG. 24, where the slat curtain 202 has been taken up on the hoisting drum 203 so that the stopper 202*a* hits. against the lower end portion of the front plate of the shutter case 212. At this time, most of the tension wire 250 has been taken up on the second balance pulley 240 so that the coil spring 231 is in the loosest state. When the operation rope unit 211 is operated to rotate the hoisting drum 3 counterclockwise in the drawing, the slat curtain 202 is fed out downward, and, at last, stops in the position where the lower end slat 204*b* hits against the lower frame 205, as shown in FIG. 25, so that the shutter 200 is brought into the fully shut state. While the slat curtain 202 is fed out downward in such a manner, the tension wire 250 is taken up around the first balance pulley 220 from the second balance pulley 240. Consequently, the second balance pulley 240 rotates to take up the coil spring 231 gradually so as to accumulate spring torque corresponding to the quantity of rotations of the hoisting drum 203.

On the contrary, when the operation rope unit 211 is operated at the fully shut position in FIG. 25 to rotate the hoisting drum 203 clockwise in the drawing, the slat curtain 202 is taken up upward, and, at last, stops in the position where the stopper 202*a* shown in FIG. 24 hits against the end portion of the shutter case, so that the shutter 200 is brought into the fully opened state. While the slat curtain 202 is taken up in such a manner, the spring torque accumulated in the coil spring 231 is released to reduce the operation force of the operation rope unit 211. That is, the tension wire 250 is taken up around the second balance pulley 240 again by the spring torque of the coil spring 231 so that a rotation force, that is, balance torque is generated in the hoisting drum 203 to thereby balance the balance torque with gravity torque (hoisting drum torque) of the slat curtain fed out from the hoisting drum 203.

Then, in the fully shut position in FIG. 25, the spring torque accumulated in the coil spring 231 does not generate a rotation force (balance torque) in the hoisting drum 203 by the feature of the shape of the first balance pulley 220 (which will be described later). Accordingly, a force to lift the slat curtain 202 up does not act on the slat curtain 202 from the hoisting drum 203. The lifting hook 215 is bent because of the elasticity of spring steel as shown in FIG. 25, and the upper end slat 204*a* of the slat curtain 202 is displaced away from the hoisting drum 203 by this bending of the lifting hook 215. Therefore, even if the slat curtain 204 is intended to be opened manually at this fully shut position, the upward movement of the upper end slat 204*a* is prevented by the stopper 207, so that it is possible to prevent the shutter from being opened illegally from the outdoor side. On the other hand, when the operation rope unit 211 is operated to rotate the hoisting drum 203, there is no bending in the lifting hook 215. Accordingly, the upper end slat 204*a* leaves the stopper 207, so that it is possible to open the slat curtain 202.

In addition, the first balance pulley 220 of the balancing device 210 has a diameter larger than that of the second balance pulley 240. With the diameter of the pulley set thus, it is possible to increase transmission torque of the balancing device 210. That is, because torque=force×turning radius, when the spring torque of the coil spring 231 is constant, a rotation force (balance torque) generated in the hoisting drum 203 by the spring torque of the coil spring 231 pulling the tension wire 250 through the second balance pulley 240 so as to rotate the first balance pulley 220 becomes larger as the diameter of the first balance pulley 220 is larger than that of the second balance pulley 240. Therefore, it is possible to reduce the spring torque of the coil spring 231 to obtain the same balance torque, so that it is possible to reduce the wire diameter of the coil spring 231. In addition, because the tensile force of the tension wire 250 is also reduced, the tension wire becomes difficult to be broken off, so that the safety thereof is improved.

Further, the initial value of the spring torque of the coil spring 231 can be adjusted to a proper value by operating the ratcheted fixed boss 232. That is, when a tool is plugged into the bolt head 262 of the fixed boss 232 and rotated counterclockwise, the ratchet 263 pushes the claw 265 up to rotate the fixed boss 232, so that the spring torque of the coil spring 231 changes. Accordingly, the initial value of the spring torque can be set to a proper value when the shutter is installed. In addition, even if the initial value of the spring torque changes due to aged deterioration, it can be reset to a proper value easily.

Next, the features of the shapes of the first balance pulley and the second balance pulley used in this embodiment will be described in detail with reference to FIGS. 27 to 29.

Figure 27B:
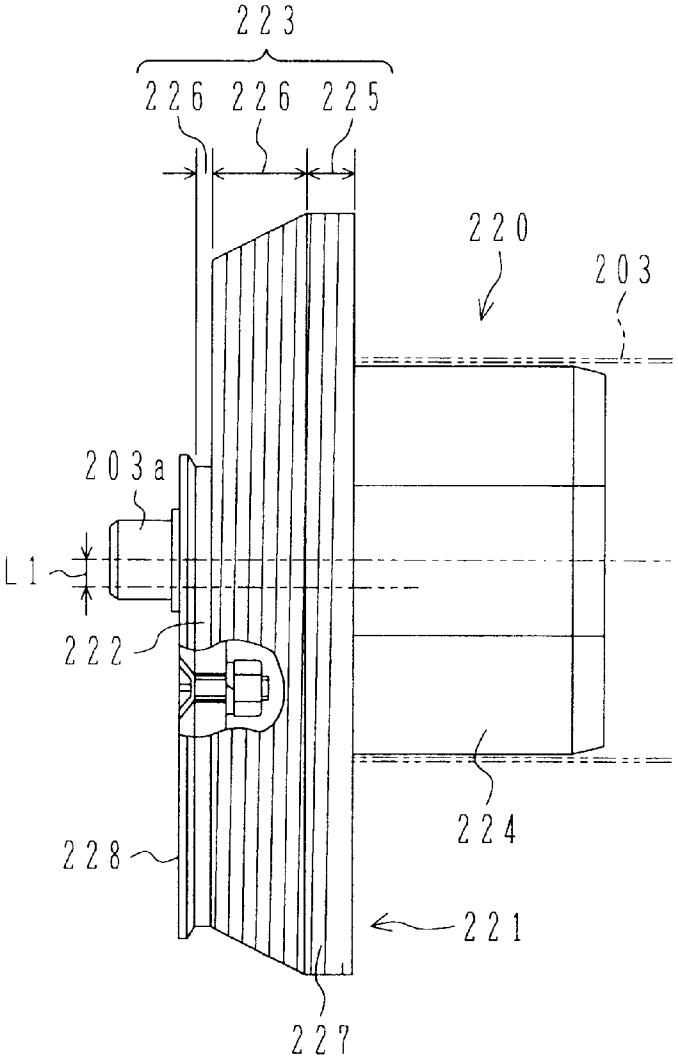
FIG. 27B is a side view illustrating a first balance pulley of the balancing device shown in FIG. 22.
Figure 27A:
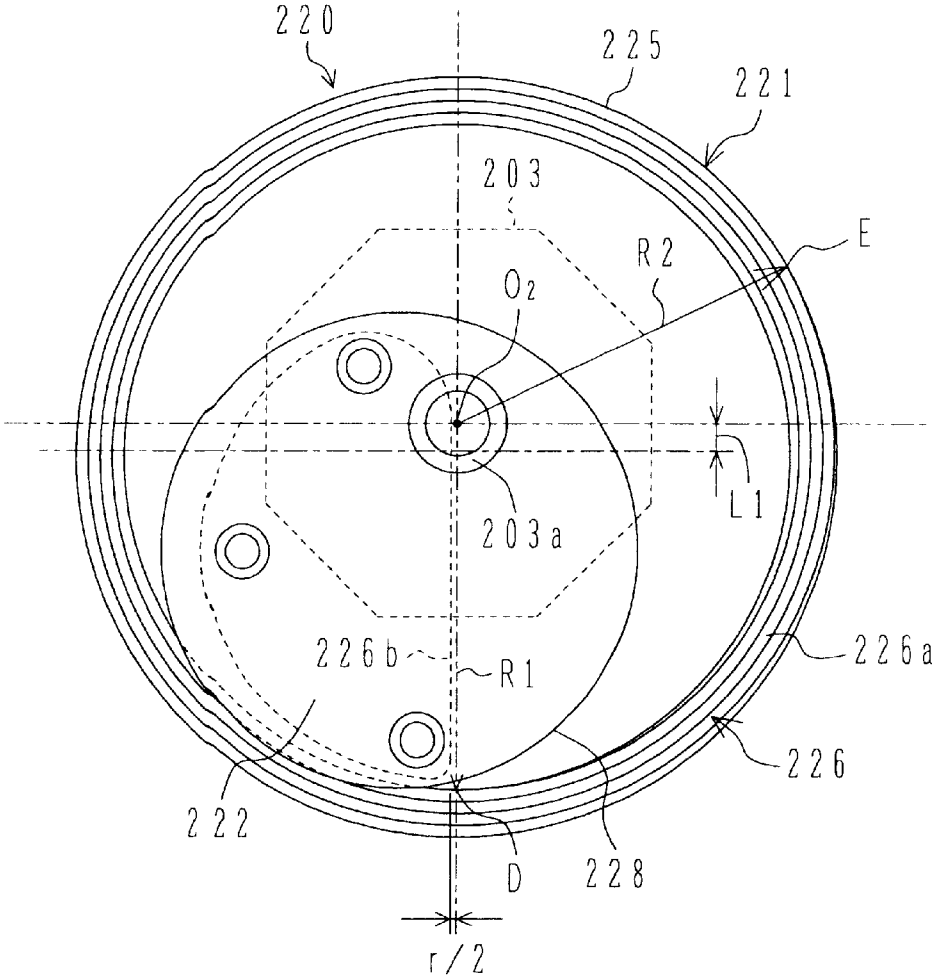
FIG. 27A is a front view illustrating a first balance pulley of the balancing device shown in FIG. 22.

First, the first balance pulley 220 is constituted by a body 221, an end plate 222 and an existing shaft portion 228, as shown in FIG. 27. The body 221 has a pulley portion 223 and a portion 224 plugged into the hoisting drum 203. The end plate 222 is attached by screws to the end surface of the pulley portion 223 of the body 220. In addition, the above-mentioned rotation shaft 203*a* is provided on the end plate 222. Because the shape of the pulley portion 223 of the body 221 is different in accordance with the shapes, materials and so on of slats, the body 221 is prepared differently in accordance with the specification of the shutter. The end plate 222 having the same shape is used in common for any sort of shutters.

The pulley portion 223 of the body 221 has a main pulley portion 225 and a zero-point return pulley portion 226. The main pulley portion 225 is constituted by a cylindrical portion. The zero-point return pulley portion 226 is constituted by a curved portion 226*a* having a diameter which becomes smaller gradually as a position goes away from the cylindrical portion of the main pulley portion, and a flat portion 226*b* which passes a position offset by about ½ of the diameter of the tension wire 250 from the axial center of the main pulley portion 225. A continuous spiral groove 227 for guiding the winding of the tension wire 250 is formed in the outer circumferential surface of the main pulley portion 225 and the outer circumferential surface of the zero-point return pulley portion 226.

Then, in this embodiment, the groove formed in the curved portion 226*a* is a spiral groove. That is, the groove formed in the curved portion 226*a*, for example, the groove formed over a distance of 3 and ⅓ rotations between a point D and a position E on the outer circumference of the curved portion 226*a* is formed into a spiral groove the radius of which changes from R1 to R2 with the displacement of the angle, on the assumption that the contact point of the flat portion 226*b* and the curved portion 226*a* is D. When the groove formed in the curved portion 226*a* is merely a spiral groove, the characteristic of balance torque meeting the mountain-like characteristic of hoisting drum torque cannot be obtained. Therefore, further, in this embodiment, the axial center of the rotation shaft 203*a* is decentered by a distance L1 from the axial center 01 of the pulley portion 223. The rotation shaft 203*a* and the portion 224 plugged into the hoisting drum 203 are coaxial with each other. The decentering L1 is set to 6 mm when the diameter 2R2 of the pulley portion 223 is ϕ120 mm. This embodiment is characterized in that the rotation center of the pulley portion 223 is decentered in such a manner. Being a simple spiral groove as mentioned above, the groove in the curved portion 226*a* shown in FIG. 27 can be produced easily by using an NC machine tool or the like. It takes much labor to form a groove constituted by an arc and a spiral arc shown in FIG. 6. The area where the spiral groove is formed is not limited to 3 and ⅓ rotations, but may be selected within the range of 3 to 5 rotations.

Figure 28A:
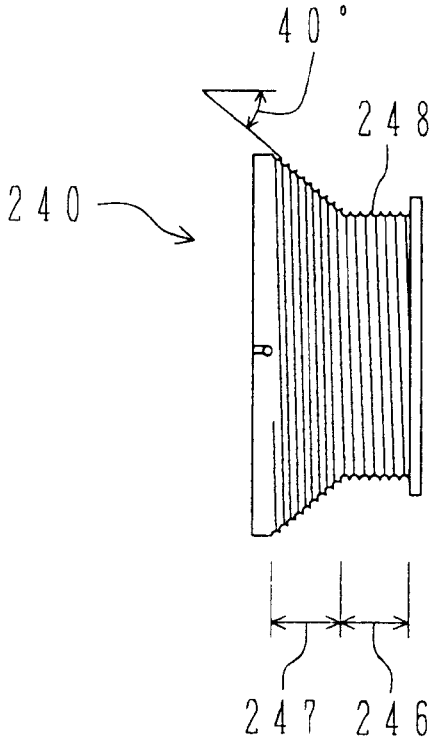
FIG. 28A is a side view illustrating a second balance pulley of the balancing device shown in FIG. 22.
Figure 28B:
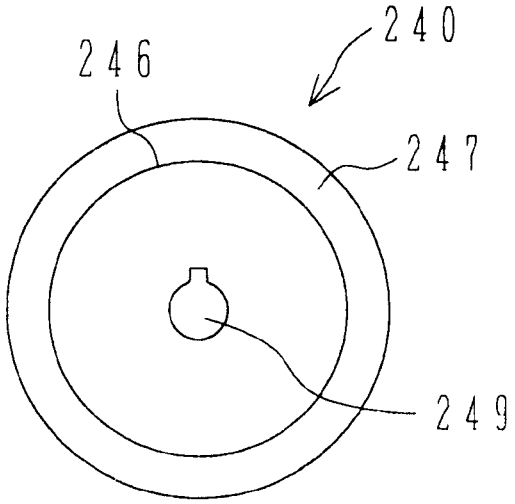
FIG. 28B is a front view illustrating a second balance pulley of the balancing device shown in FIG. 22.

The second balance pulley 240 has a cylindrical portion 246 and a conical portion 247, as shown in FIG. 28. The conical portion 247 has a conical shape having a diameter which is smaller on the cylindrical portion 246 side than on the side opposite to the cylindrical portion 246, and which is the same on the cylindrical portion 246 side as the diameter of the cylindrical portion 246. A continuous spiral groove 248 for guiding the winding of the tension wire 250 is formed also in the outer circumferential surface of the cylindrical portion 246 and the outer circumferential surface of the conical portion 247. In addition, a through hole 249 to which the shaft 245 is key-connected is formed at the center portions of the cylindrical portion 246 and the conical portion 247. Then, the pitch of the groove formed in the cylindrical portion 246 is set to 1.6 mm, and the pitch of the grooved formed in the conical portion 247 is set to 2.2 mm. On the other hand, the pitch of the groove formed in the main pulley portion 225 and the zero-point return pulley portion 226 of the first balance pulley 220 is set to 2.5 mm. That is, the pitch of the guide groove of the second balance pulley 240 is made smaller than the pitch of the guide groove of the first balance pulley.

Figure 29A:
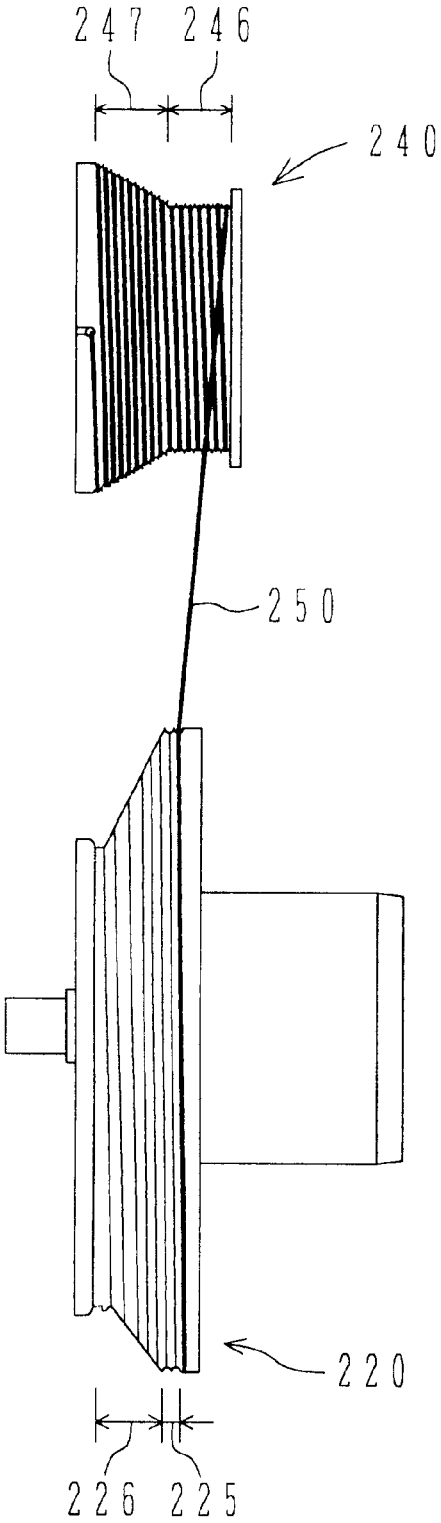
FIG. 29A is a view showing the relationship of winding of a tension wire between the first balance pulley and the second balance pulley in the fully opened position of the shutter.
Figure 29B:
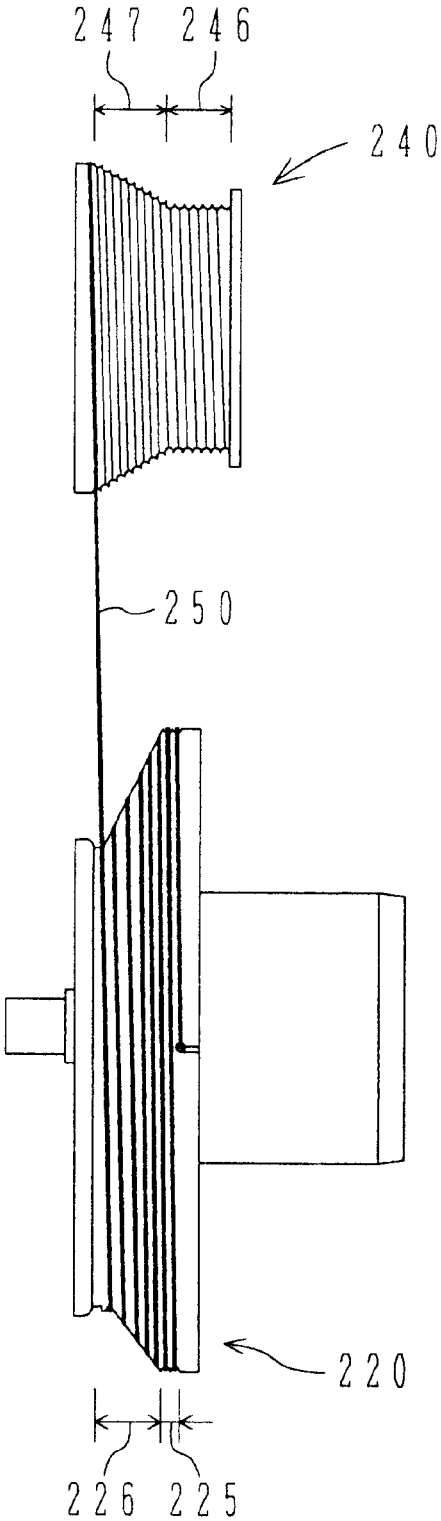
FIG. 29B is a view showing the relationship of winding of a tension wire between the first balance pulley and the second balance pulley in the fully shut position of the same.

When the slat curtain 202 is fed-out at the fully opened position, the main pulley portion 225 of the first balance pulley 220 constitutes a first pulley portion for taking-up the tension wire 250 at the beginning of the feed-out process, as shown in FIG. 29(*a*). On the other hand, as shown in FIG. 29(*b*), the zero-point return pulley portion 226 constitutes a second pulley portion for taking-up the tension wire 250 from halfway, and the flat portion 226*b* of the zero-point return pulley portion 226 is positioned so that the tension wire 250 passes the axial center 0 of the main pulley portion 225 (the axial center of the first balance pulley 220) when the slat curtain 202 has been fed out to the fully shut position (see FIG. 25).

In addition, when the slat curtain 202 is fed out at the fully opened position, the cylindrical portion 246 of the second balance pulley 240 constitutes a third pulley portion for feeding-out the tension wire 250 at the beginning of the feed-out process, as shown in FIG. 29(*a*). On the other hand, as shown in FIG. 29(*b*), the conical portion 247 of the second balance pulley 240 constitutes a fourth pulley portion for feeding-out the tension wire 250 from halfway, and this conical portion 247 has a tapered shape having a diameter which is smaller on the cylindrical portion 246 side.

The operation of the thus configured balancing device 210 will be described.

First, the operation of the zero-point return pulley portion 226 of the first balance pulley 220 will be described with reference to FIG. 29.

When the slat curtain 202 is fed out downward at the fully opened position of the shutter, the tension wire 250 taken up around the second balance pulley 240 as shown in FIG. 29(*a*) is taken up around the first balance pulley 220. When the slat curtain 202 is fed out to the fully shut position, the tension wire 250 is taken up around the zero-point return pulley portion 226 of the first balance pulley 220 as shown in FIG. 29(*b*). Then, the flat portion 226*b* of the zero-point return pulley portion 226 is positioned so that the tension wire 250 passes the axial center 0 of the main pulley portion 225 (the axial center of the first balance pulley 220) when the slat curtain 202 has been fed out to the fully shut position, as mentioned above. Therefore, when the slat curtain 202 has been fed out to the fully shut position in such a manner, the tension wire 250 passes the axial center 0 of the main pulley portion 225 (see FIG. 25), so that no rotation torque is generated in the first balance pulley 220 even if a tensile force acts on the tension wire 250 by the spring torque of the coil spring 231. That is, balance torque caused by the coil spring 231 is not generated in the hoisting drum 203.

Therefore, a winding-up force from the hoisting drum 203 to the slat curtain 202 does not act in the fully shut position of the shutter, but only the own weight of the slat curtain 202 acts on the hoisting drum 203. Accordingly, the slat curtain 202 is supported by the lower frame 205, and the hoisting drum 203 is made free. As a result, it will go well if there is provided such a simple lock device that the lifting hook 215 is formed of spring steel and the stopper 207 is provided at the upper end of the guide rail 201 as mentioned above. It becomes unnecessary to provide any special lock for preventing the slat curtain 202 from moving up by the balance torque of the hoisting drum 203 in the fully shut position.

In addition, when the balancing device is used in an air-slit type shutter, it is possible to shut an air slit in the fully shut position.

The operation of this zero-point return pulley portion 226 is described in detail in JP-A-5-163880.

Next, the relationship between hoisting drum torque and balance torque according to this embodiment will be described with reference to FIG. 30.

Figure 30:
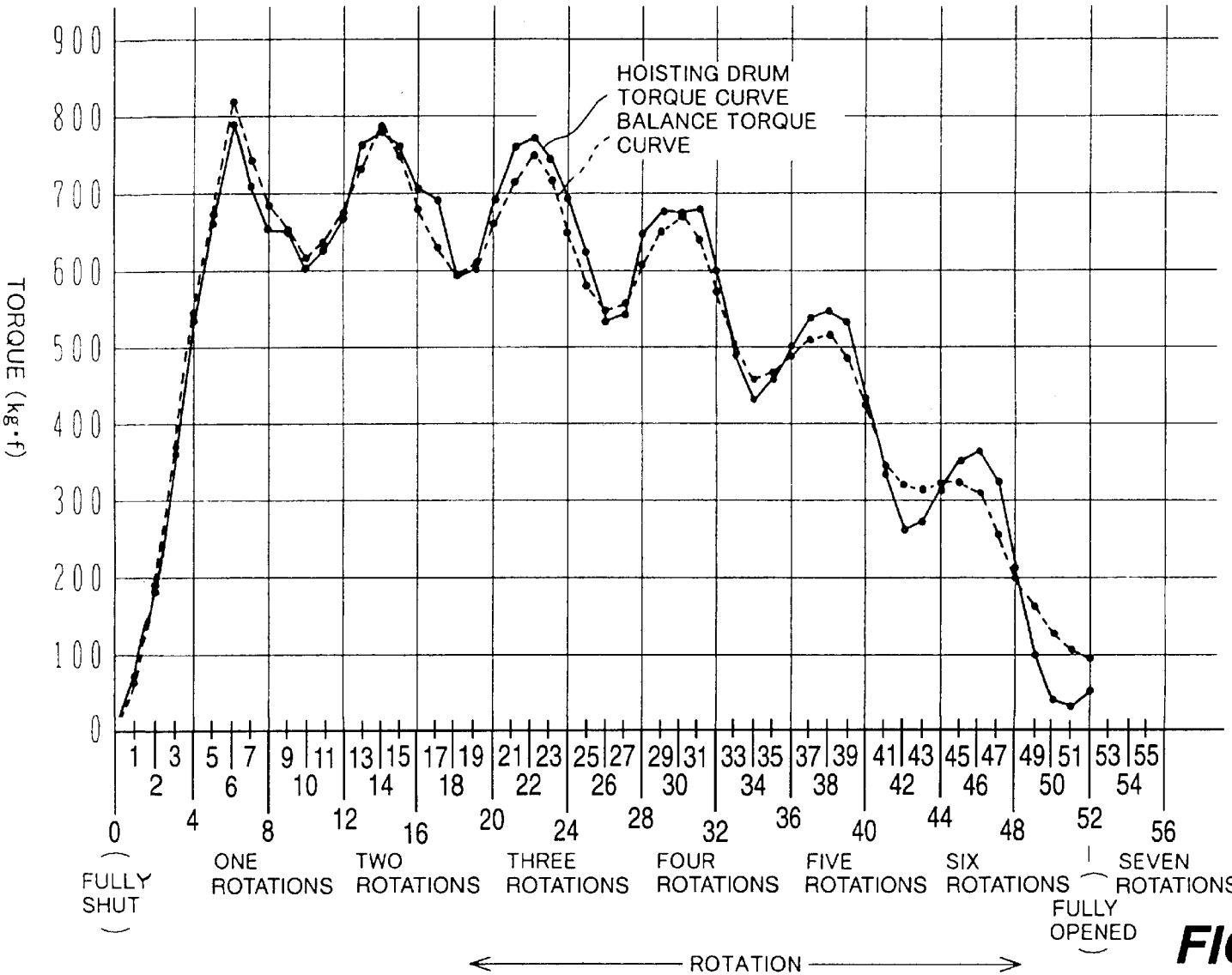
FIG. 30 is a graph showing a balance torque curve and a hoisting drum torque curve in this embodiment.

In the balance torque curve in FIG. 30, graduated in 45° rotation of the hoisting drum, torque obtained by the calculation of the wire tensile force and the effective diameter of the first balance pulley at that time was plotted every graduation from the zero point of the fully shut position of the shutter (the position where the tension wire 250 passes the axial center 0 of the main pulley portion 225).

In the hoisting drum curve, actual measurements were also plotted every graduation of 45° rotations of the hoisting drum in the same manner as described above.

The hoisting drum torque rises suddenly, takes the maximum value on the 6th graduation (¾ rotation), thereafter goes down with a considerably sharp angle, and reaches a bottom of a valley on the 10th graduation (one and ¼ rotations). Thereafter, the hoisting drum torque goes up at a considerably sharp angle again, and makes a second peak on the 14th graduation (one and ¾ rotations). Then, the hoisting drum torque goes down rightward, while repeating some peaks on the 22nd graduation (two and ¾ rotations), on the 30th graduation (3 and ¾ rotations), on the 38th graduation (4 and ¾ rotations), and on the 45th graduation (5 and ⅝ rotations). At that time, the value of each peak decreases gradually, but the torque difference between each peak and the corresponding bottom does not decrease in the sequence.

Then, as mentioned above, the change of the balance torque till the 6th graduation (¾ rotations) is caused by the wire tensile force curve improved by the conical portion of the second balance pulley 240 and the shapes of the curved portion 226*a* of the zero-point return pulley portion 226 of the first balance pulley 220. The change of the balance torque after that is caused by the shapes of the conical portion and the cylindrical portion of the second balance pulley 240 and the shape of the flat portion and the cylindrical portion 223 of the first balance pulley 220. Particularly, in this embodiment, because the rotation center of the pulley portion 223 is decentered, a peak of the balance torque appears at the ¾ rotation position in every rotation. Consequently, it is possible to make the characteristic of the balance torque approach the characteristic of the hoisting drum torque, so that it is possible to reduce the difference between the hoisting drum torque and the balance torque. As a result, the operation force when the shutter is opened/shut can be reduced over a wide range from the fully shut state to the fully opened state.

In addition, in this embodiment, the groove formed in the curved portion 226 can be formed more easily than that in the first embodiment shown in FIG. 6. That is, the groove formed in the curved portion 26*a* in FIG. 6 is formed as follows. When the contact point between the zero-point return pulley portion and the curved portion 26*a* is A, for example, the groove formed between the point A and a point B in the position of the angle 270° from the point A is an arc groove the radius of which is R1. In a point C on the circumferential side of the point A, the radius is R1+ΔR. When R1 is 70 mm, ΔR is about 10 mm. The groove formed over the angle over 90° between the point B and the point C is a spiral arc groove the radius of which is changed from R1 to R1+ΔR gradually with the displacement of the angle. The reason why such a modified spiral groove is formed is to make the balance torque coincide with the hoisting drum torque by means of the delicate shape of the curved portion 26*a*.

On the other hand, in this embodiment, as mentioned above, the groove formed in the curved portion 226 is a spiral groove, which can be formed easily by using an NC machine tool or the like.

Although the eccentricity L1 was set to 6 mm when the diameter 2R2 of the pulley portion 223 is ϕ120 mm as mentioned above, this eccentricity L1 needs to be changed corresponding to the size and shape of the first balance pulley and the second balance pulley, and the hoisting drum torque curve. Specifically, the decentering needs to be obtained so that the balance torque coincides with a target hoisting drum torque curve.

As has been described, in this embodiment, because the conical portion 247 is provided in the second balance pulley 240, the wire tensile force curve is improved to approach the hoisting drum torque curve. Consequently, the difference between the hoisting drum torque and the balance torque is reduced all over the range of the shutter open/shut operation. Accordingly, there does not occur such a problem that the slat curtain is heavy immediately before the shutter is fully shut, while the slat curtain dashes immediately after the shutter is opened from its fully shut state.

Further, because the rotation center of the pulley portion 23 is decentered, a peak of balance torque appears at a position of ¾ rotation in every rotation. Consequently, it is possible to reduce the difference between the hoisting drum torque and the balance torque all over the range of the shutter open/shut operation. As a result, the operation force when the shutter is opened/shut can be reduced over a wide range from its fully shut state to its fully opened state, so that a smooth open/shut operation of the shutter can be attained at any position where the shutter is opened/shut.

In addition, the peaks can be generated in the characteristic of the balance torque only by the decentering of the rotation center of the pulley portion 223. Therefore, it is not necessary to form a spiral groove having a complicated shape, as in the elder application, and it is easy to manufacture the first balance pulley.

In addition, the wire tensile force curve is improved so that the shape of the main pulley portion 225 of the first balance pulley 220 can be made simple so as to have only a cylindrical portion, and the design can be changed easily for any sort of shutters such as an air-slit type shutter. Furthermore, even if the design is changed for another sort of shutter, for example, for an aluminum roll-formed shutter, balance torque can be set so as to change while substantially meeting a delicate curve of hoisting drum torque in the same manner as in the case of a steel shutter. Accordingly, the operation property of the shutter can be made superior in the same manner as in the case of the steel shutter. That is, the balance pulley according to the present invention can be used in any sort of shutters, and have superior operation property.

In addition, because the balance accuracy is improved on a large scale, the rope diameter of the operation rope may be ϕ3.0 mm to ϕ3.5 mm, substantially as large as that in an interior blind, so that the duct can be made small, and the diameter of the inlet of the duct can be also reduced. Because the diameter of the inlet can be reduced, it is possible to improve the air tightness of the building.

Next, the operation rope unit 211 and a safety device relating thereto will be described in detail with reference to FIGS. 22, 23 and 31 to 32.

Figure 31:
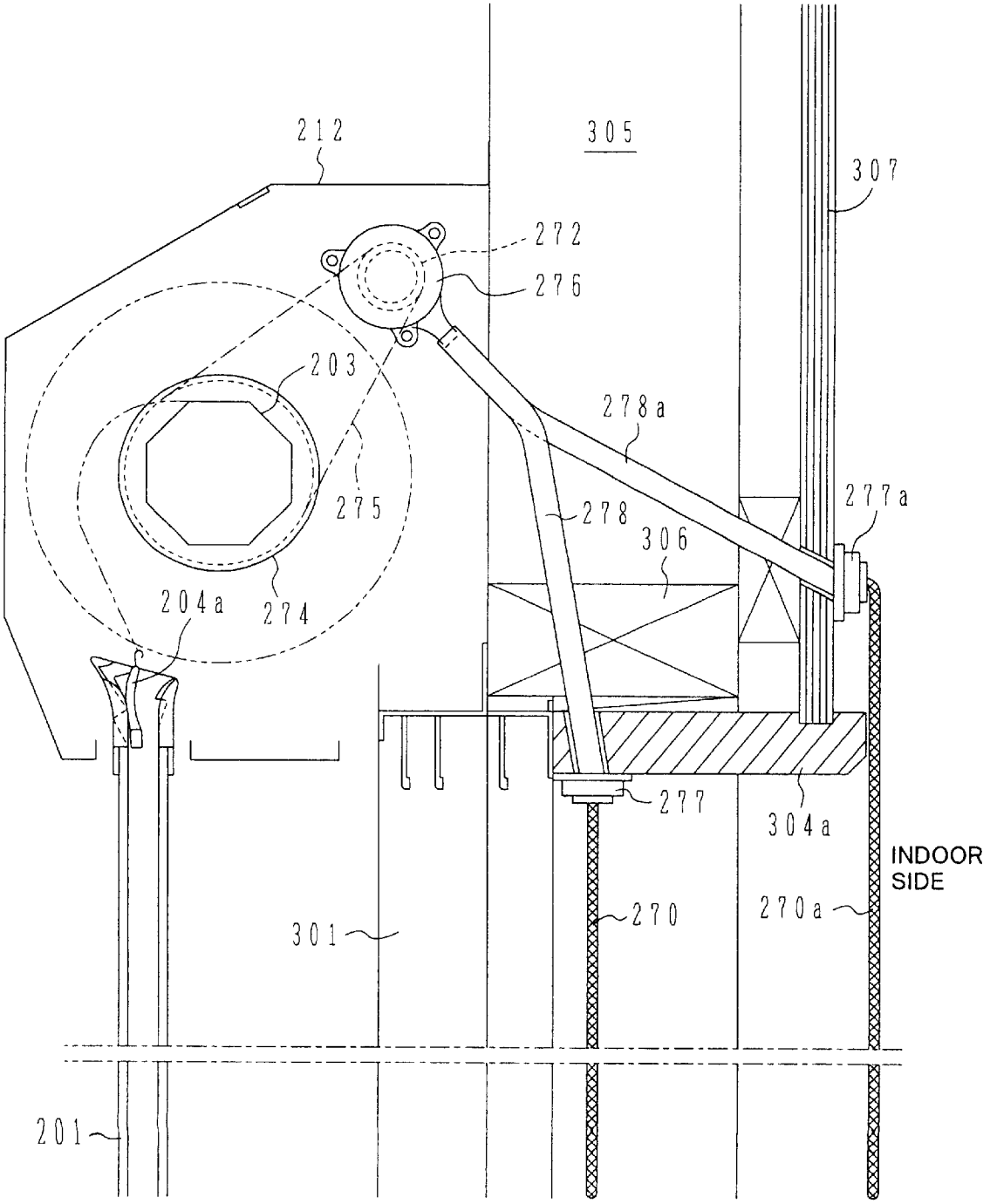
FIG. 31 is a view showing the state of pulling out an operation rope of an operation rope unit.

As shown in FIGS. 23 and 31, the operation rope unit 211 has an operation rope 270, a reverse rotation preventing device 273 having a rope pulley 271 around which this operation rope 270 is engaged and a small pulley 272, a large pulley 274 attached to the end cap 203*c* of the hoisting drum 203, and a timing belt 275 engaged around the small pulley 272 and the large pulley 274. A part of the operation rope 270 is introduced to the indoor side, and the operation rope 270 is operated on the indoor side, so that the hoisting drum 203 can rotate. The operation rope 270 is an endless rope made of synthetic fiber. The rope pulley 271 around which this operation rope 270 is engaged has a U-or V-groove, and this groove surface has a protrusive pattern to increase the frictional resistance with the rope.

The portion of the rope pulley 271 of the reverse rotation preventing device 273 is covered with a cover 276. The position where the small pulley 272 and the reverse rotation preventing device 273 are installed is set near the wall obliquely above the hoisting drum 203, for purpose of preventing of falling of water-drops thereon, and reducing falling of dust thereon.

In addition, in order to introduce the operation rope 270 to the indoor side, a pedestal 277 is attached to an upper frame 304*a* forming a wooden decoration frame of a open space, and the operation rope 270 is hung down from the upper portion of the wooden decoration frame. On the other hand, a pedestal 277*a* is attached to an inner wall 307 of the building. A duct 278*a* connects the pedestal 277*a* and the cover 276 to each other. When the pedestal 277*a* is disposed as described above, an operation rope 270*a* may be disposed to be hung down from the inner wall 307 of the building. The duct 278 or 278*a* is shaped into a pipe made of flexible material such as plastic, having a large degree of freedom with respect to the attachment position of the pedestal 277 or 277*a*. By passing the operation rope 270 or 270*a* through the duct 278 or 278*a*, it is possible to operate smoothly the operation rope 270 or 270*a* even if there is a difference in the position relationship between the rope pulley 271 and the pedestal 277 or 277*a*. In addition, because the operation rope 270 or 270*a* is covered with the duct 278 or 278*a* and the cover 276, the operational rope has such a structure that dust hardly adheres thereto.

Figure 32:
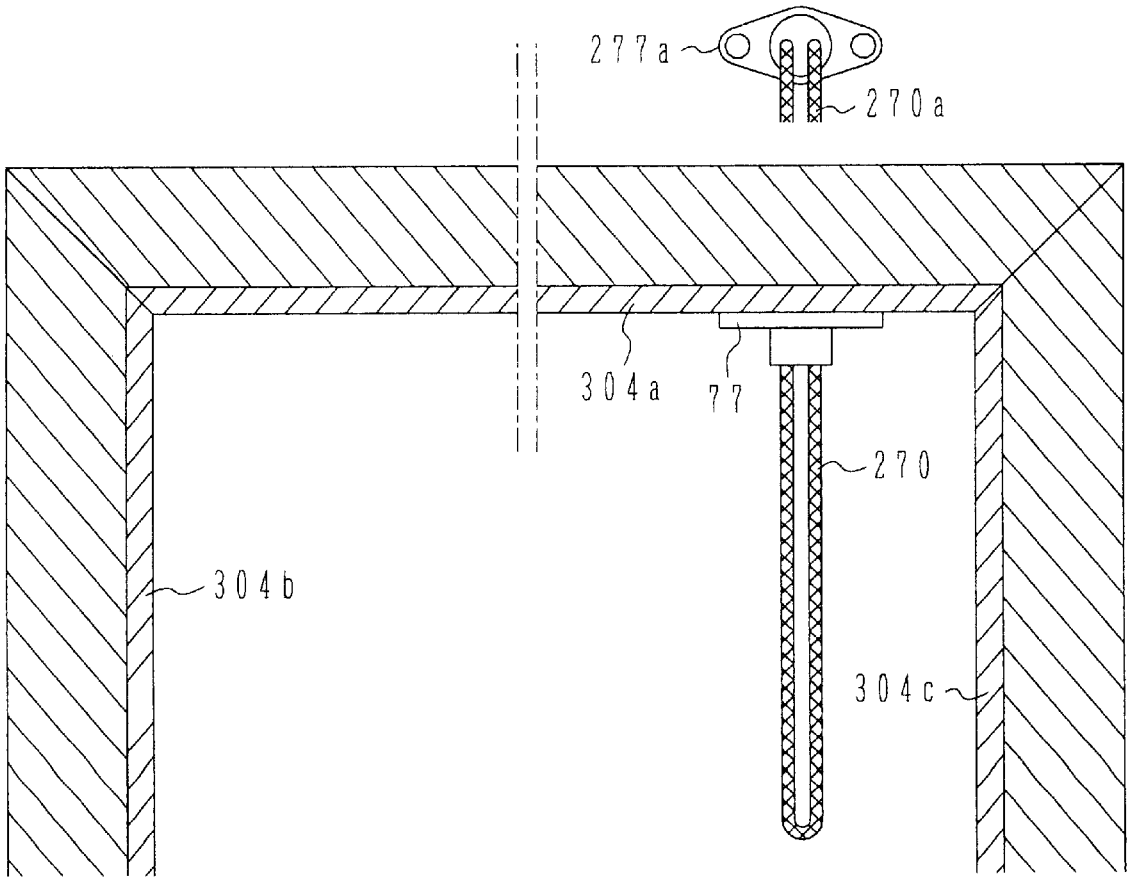
FIG. 32 is a view illustrating the operation rope, viewed from the indoor side.

FIG. 32 shows the operation rope 270 viewed from the indoor side. The operation rope 270 is hung down from the upper frame 304*a*, or in the right of the window on the inner wall of the building.

In FIGS. 23, 24, and 31 to 32, the reference numeral 301 represents a frame of the sash; 304*a* and 304*b*, wooden decoration frames; 305, a pillar; 306, a crossbar; 307, an inner wall; and 308, an outer wall.

By leading-out the operation rope 270 to the indoor side by use of a sash door stop 302, the following advantages can be obtained.

The technique in which the operation rope is introduced into the indoor side is proposed in JP-A-9-72174. However, in this proposal, a rope wheel is attached to the other end of the hoisting drum, and the operation rope is engaged on the rope wheel and led out to the indoor side. In such a manner, though more or less different in accordance with the sort of sash or the like, there often arises a case where a hole is formed in the pillar 305 and/or the inner wall 307 in the outside of the pillar 305. However, formation of a through hole for the operation rope in a building body such as a wall, a pillar or the like involves a problem in the structure of the building. Therefore, it has met a very large resistance. In addition, there are various problems in strength, appearance, construction, etc. in the case of the pillar. Further, because the position where the rope is led out is outside the sash attachment opening width (window), it is difficult to select the portion where the through hole for the operation rope is formed, and there occurs a problem concerning the convenience for right-handed and left-handed, when the shutter is attached to a window in a corner portion of the building.

INDUSTRIAL AVAILABILITY

According to the present invention, not only it is possible to apply the balancing device to any sort of slats, but also it is possible to provide a shutter in which neither collision sound nor dash occurs at the time of opening/shutting the shutter and which is superior in operation property.

In addition, according to the present invention, not only it is possible to make a coil spring of the balancing device compact, but also a tension wire is hardly broken off so that the safety can be improved.

Further, according to the present invention, it is possible to introduce an operation rope to the indoor side without giving any change to a building body, so that the installation is very simple. In addition, there occurs no problem in strength or in appearance, and further there occurs no problem concerning the convenience for right-handed and left-handed.

In addition, according to the present invention, it is possible to perform a conventional open/shut operation of the shutter when the operation rope is operated, while high safety can be ensured because the rotation of the hoisting drum is prevented in case of emergency where the hoisting drum is rotated by an external force.

In addition, according to the present invention, it is possible to prevent the shutter from being opened from the outdoor side illegally even in the case where no special lock device is provided. Accordingly, it is possible to ensure high performance to prevent crimes.

According to the present invention, it is possible to reduce an operation force over a wide range from the fully shut state to the fully opened state of the shutter. Accordingly, it is possible to improve the operation property.

In addition, according to the present invention, because the accuracy of balance is improved on a large scale, the operation force is reduced, so that the diameter of the operation rope may be reduced. Accordingly, it is easy to introduce the operation rope to the indoor.

According to the present invention, not only it is possible to apply the balancing device to any sort of slats, but also it is possible to provide a shutter in which neither collision sound nor dash occurs at the time of opening/shutting the shutter and which is superior in operation property.

Further, according to the present invention, because of the high balance accuracy, it is possible to reduce the reduction ratio of an operation system. Accordingly, it is possible to attain light and speedy operation.

Further, according to the present invention, it is possible to introduce an operation rope to the indoor side without giving any change to a building body, so that the installation is very simple. In addition, there occurs no problem in strength or in appearance, and further there occurs no problem concerning the convenience for right-handed and left-handed.

I claim:

1. A balanced shutter comprising: a hoisting drum (3) for taking-up and feeding-out a slat curtain (2); a balancing device (10) for accumulating spring torque corresponding to the quantity of rotations of said hoisting drum (3) when said slat curtain (2) is fed out from said hoisting drum (3), thereby balancing said spring torque with hoisting drum torque due to said slat curtain (2) fed out; and a manual operation means (70) for operating said hoisting drum so as to rotate said hoisting drum;

characterized in that said balancing device (10) includes:

a coil spring (31) for accumulating said spring torque;

a first balance pulley (20) provided at one end of said hoisting drum;

a second balance pulley (40) disposed adjacently to said first balance pulley and connected to one end of said coil spring; and a tension wire (50) one end of which is connected to said first balance pulley while the other end is connected to said second balance pulley;

said first balance pulley (20) having a first pulley portion (25) for taking-up said tension wire at the beginning of a feed-out process when said slat curtain is fed out at a fully opened position, and a second pulley portion (26) for taking-up said tension wire from halfway of said feed-out process, said second pulley portion having an outer-circumferential shape in which said tension wire passes an axial center of said first pulley portion when said slat curtain is fed out to a fully shut position;

said second balance pulley (40) having a third pulley portion (46) for feeding-out said tension wire at the beginning of the feed-out process when said slat curtain is fed out at the fully opened position, and a fourth pulley portion (47) for feeding-out said tension wire from halfway of said feed-out process, said fourth pulley portion having a tapered shape so that a diameter thereof is made smaller on the third pulley portion side; and said manual operation means (70) having an operation rope (70) for operating said hoisting drum to rotate said hoisting drum on the indoor side.

2. A balanced shutter according to claim 1, characterized in that the tapered shape of said fourth pulley portion (47) is a conical shape.

3. A balanced shutter according to claim 1, characterized in that said first pulley portion (25) and said third pulley portion (46) have cylindrical shapes respectively.

4. A balanced shutter according to claim 1, characterized in that the diameter of said first balance pulley (20) is larger than that of said second balance pulley (40).

5. A balanced shutter according to claim 1, characterized in that said manual operation means has a configuration in which a through hole (103) is vertically formed in a door stop of a sash upper frame so that said operation rope (70) is introduced to the indoor side through said through hole.

6. A balanced shutter according to claim 1, characterized in that said operation rope (70) is connected to said hoisting drum through a reverse rotation preventing device (73) which transmits a rotation operation from said operation rope to said hoisting drum (3) but does not transmit rotation from said hoisting drum to said operation rope to thereby prevent the rotation of said hoisting drum.

7. A balanced shutter according to claim 6, characterized in that said reverse rotation preventing device (73) includes: a rotation shaft (85) which is provided adjacently to the end portion of said hoisting drum (3) opposite to said first balance pulley (20) and which is connected to said hoisting drum (3) through a rotation transmitting mechanism; a rope pulley (71) which is supported rotatably on said rotation shaft and on which said operation rope is engaged; and an one-directional rotation transmitting mechanism (86) which is provided between said rotation shaft and said rope pulley so that said rotation shaft is rotated by the rotation of said rope pulley but said rotation shaft is not rotated by the rotation of said rotation transmitting mechanism.

8. A balanced shutter according to claim 1, characterized in that an upper end slat (4*a*) of said slat curtain (2) is connected to said hoisting drum (3) through a lifting hook (15) made from elastic material, and a stopper (7) is provided at an upper end of a rail guide (1) for guiding the opposite side portions of said slat curtain (2) so that said stopper (7) prevents upward movement of said upper end slat displaced away from said hoisting drum.

9. A balancing device of a shutter for accumulating spring torque corresponding to the quantity of rotations of a hoisting drum (3) when a slat curtain (2) is fed out from said hoisting drum (3), thereby balancing said spring torque with hoisting drum torque due to said slat curtain fed out, characterized by comprising:

a coil spring (31) for accumulating said spring torque;

a first balance pulley (20) connected to said hoisting drum so as to rotate synchronously with said hoisting drum;

a second balance pulley (40) disposed adjacently to said first balance pulley and connected to one end of said coil spring; and a tension wire (50) one end of which is connected to said first balance pulley while the other end is connected to said second balance pulley;

said first balance pulley (20) having a first pulley portion (25) for taking-up said tension wire at the beginning of a feed-out process when said slat curtain is fed out at a fully opened position, and a second pulley portion (26) for taking-up said tension wire from halfway of said feed-out process, said second pulley portion having an outer-circumferential shape in which said tension wire passes an axial center of said first pulley portion when said slat curtain is fed out to a fully shut position;

said second balance pulley (40) having a third pulley portion (46) for feeding-out said tension wire at the beginning of the feed-out process when said slat curtain is fed out at the fully opened position, and a fourth pulley portion (47) for feeding-out said tension wire from halfway of said feed-out process, said fourth pulley portion having a tapered shape so that a diameter thereof is made smaller on the third pulley portion side.

10. A balanced shutter comprising a hoisting drum (203) for taking-up and feeding-out a slat curtain (202); a balancing device (210) for accumulating spring torque corresponding to the quantity of rotations of said hoisting drum when said slat curtain is fed out from said hoisting drum, thereby balancing said spring torque with hoisting drum torque due to said slat curtain fed out; and a manual operation means (211) for operating said hoisting drum so as to rotate said hoisting drum;

characterized in that said balancing device (210) includes:

a coil spring (231) for accumulating said spring torque;

a first balance pulley (220) provided at one end of said hoisting drum;

a second balance pulley (240) disposed adjacently to said first balance pulley and connected to one end of said coil spring; and a tension wire (250) one end of which is connected to said first balance pulley while the other end is connected to said second balance pulley;

said first balance pulley (220) having a first pulley portion (225) for taking-up said tension wire at the beginning of a feed-out process when said slat curtain is fed out at a fully opened position, and a second pulley portion (226) for taking-up said tension wire from halfway of said feed-out process, said second pulley portion having an outer-circumferential shape in which said tension wire passes an axial center of said first pulley portion when said slat curtain is fed out to a fully shut position;

said first balance pulley (220) further having a rotation center in a position decentered from its central axis;

said second balance pulley (240) having a third pulley portion (246) for feeding-out said tension wire at the beginning of the feed-out process when said slat curtain is fed out at the fully opened position, and a fourth pulley portion (247) for feeding-out said tension wire from halfway of the feed-out process, said fourth pulley portion having a tapered shape so that a diameter thereof is made smaller on the third pulley portion side;

said manual operation means (211) having an operation rope (270) for operating said hoisting drum to rotate said hoisting drum on the indoor side.

11. A balanced shutter according to claim 10, characterized in that said manual operation means (211) has an operation terminal in the inside of the opening width of said shutter (200), and has a configuration in which said operation rope (270) is introduced to the indoor side through a frame (104*a*) in an upper portion of a sash angle or a window opening or an inner wall (107) of a building.

12. A balanced shutter according to claim 10, characterized in that a pitch of a guide groove of said second balance pulley (240) is made smaller than a pitch of a guide groove of said first balance pulley (220).

* * * * *